US006906726B2

(12) United States Patent
Suzuki

(10) Patent No.: US 6,906,726 B2
(45) Date of Patent: Jun. 14, 2005

(54) DISPLAY DEVICE

(75) Inventor: Masahiro Suzuki, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 186 days.

(21) Appl. No.: 10/171,966

(22) Filed: Jun. 17, 2002

(65) Prior Publication Data

US 2003/0006994 A1 Jan. 9, 2003

(30) Foreign Application Priority Data

Jun. 28, 2001 (JP) ..... 2001-196253

(51) Int. Cl.[7] ..... G09G 5/02

(52) U.S. Cl. ..... 345/596; 345/600; 345/37; 345/60

(58) Field of Search ..... 345/596, 600, 345/37, 60

(56) References Cited

U.S. PATENT DOCUMENTS 6,476,824 B1 * 11/2002 Suzuki et al. ..... 345/690

* cited by examiner

*Primary Examiner*—Matthew C. Bella
*Assistant Examiner*—Tam Tran
(74) *Attorney, Agent, or Firm*—Sughrue Mion, PLLC

(57) ABSTRACT

A display device which can perform excellent image display with reduced dither noise. Values of dither coefficients that are allotted to respective pixel positions in a pixel group are altered between when the brightness level of an image displayed by the pixel data is lower than a prescribed brightness and when the brightness level of the image falls within a prescribed intermediate brightness range.

20 Claims, 18 Drawing Sheets

FIG. 8

| GRADATION | CONVERSION TABLE OF SECOND DATA CONVERSION CIRCUIT 34 | | | | | | | | | | | | | SINGLE FIELD LIGHT-EMISSION DRIVE PATTERN | | | | | | | | | | | | BRIGHTNESS | |
|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | SF 1 | SF 2 | SF 3 | SF 4 | SF 5 | SF 6 | SF 7 | SF 8 | SF 9 | SF 10 | SF 11 | SF 12 | FIRST LIGHT EMISSION | SECOND LIGHT EMISSION |
| 1 | 0000 | 1 | 0 | 0 | 0 | 0 | 0 | 0 | 0 | 0 | 0 | 0 | 0 | ● | | | | | | | | | | | | 0 | 0 |
| 2 | 0001 | 0 | 1 | 0 | 0 | 0 | 0 | 0 | 0 | 0 | 0 | 0 | 0 | ○ | ● | | | | | | | | | | | 2 | 1 |
| 3 | 0010 | 0 | 0 | 1 | 0 | 0 | 0 | 0 | 0 | 0 | 0 | 0 | 0 | ○ | ○ | ● | | | | | | | | | | 5 | 3 |
| 4 | 0011 | 0 | 0 | 0 | 1 | 0 | 0 | 0 | 0 | 0 | 0 | 0 | 0 | ○ | ○ | ○ | ● | | | | | | | | | 8 | 7 |
| 5 | 0100 | 0 | 0 | 0 | 0 | 1 | 0 | 0 | 0 | 0 | 0 | 0 | 0 | ○ | ○ | ○ | ○ | ● | | | | | | | | 18 | 13 |
| 6 | 0101 | 0 | 0 | 0 | 0 | 0 | 1 | 0 | 0 | 0 | 0 | 0 | 0 | ○ | ○ | ○ | ○ | ○ | ● | | | | | | | 29 | 23 |
| 7 | 0110 | 0 | 0 | 0 | 0 | 0 | 0 | 1 | 0 | 0 | 0 | 0 | 0 | ○ | ○ | ○ | ○ | ○ | ○ | ● | | | | | | 46 | 37 |
| 8 | 0111 | 0 | 0 | 0 | 0 | 0 | 0 | 0 | 1 | 0 | 0 | 0 | 0 | ○ | ○ | ○ | ○ | ○ | ○ | ○ | ● | | | | | 68 | 56 |
| 9 | 1000 | 0 | 0 | 0 | 0 | 0 | 0 | 0 | 0 | 1 | 0 | 0 | 0 | ○ | ○ | ○ | ○ | ○ | ○ | ○ | ○ | ● | | | | 96 | 81 |
| 10 | 1001 | 0 | 0 | 0 | 0 | 0 | 0 | 0 | 0 | 0 | 1 | 0 | 0 | ○ | ○ | ○ | ○ | ○ | ○ | ○ | ○ | ○ | ● | | | 131 | 112 |
| 11 | 1010 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ● | | 174 | 151 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 225 | 198 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 | 255 |

BLACK CIRCLES : SELECTIVE ELIMINATION DISCHARGE
WHITE CIRCLES : SUSTAINED DISCHARGE LIGHT EMISSION

DISPLAY DEVICE

BACKGROUND OF THE INVENTION

1. Field of the Invention

The present invention relates to a display device including a dither processing circuit.

2. Description of the Related Art

Recently, plasma display panels (hereinbelow abbreviated as PDPS) in which a plurality of discharge cells having the function of pixels are arranged in matrix fashion to constitute a two-dimensional image display panel have attracted attention. In a PDP, discharge cells are respectively caused to discharge in response to pixel data of each pixel, under the control of a video (image) signal, thereby forming a display image on the screen by the emission of light which accompanies the discharge. As the method of driving such a PDP, the subfield method is known, in which drive is conducted with the display period of a single field divided into a plurality of subfields (subperiods). For example, the display period of a single field may be divided into N subfields (namely, subfields SF1, SF2, . . . , SF(N)), in the order of weighting. In each subfield, there are executed an addressing step in which the pixels are set to the illuminated pixel condition or the extinguished pixel condition in accordance with pixel data, and emission sustaining (maintenance) step, in which only those pixels which are in the above-mentioned illuminated pixel condition are made to emit light for a period corresponding to the weighting of this subfield. Consequently, a single field contains a mixture of subfields in which light emission from discharge cells is caused in the emission sustaining step and subfields in which no light emission from discharge cells is caused (or extinction of the discharge cells is retained). Thus, in a single field period, intermediate brightness is observed corresponding to the total time for which light emission is performed in the respective subfields.

In a display device using a PDP, picture quality may be improved by increasing the number of perceived gradations. The number of perceived gradations increases if the drive as described above is combined with dither processing.

In the dither processing, for example, four vertically and horizontally adjacent pixels are designated as a single group, and four dither coefficients (for example, 0, 1, 2, 3) having mutually different coefficient values are added to the pixel data corresponding to the respective pixels of this group. The apparent (pseudo) number of gradations can be increased by such dither processing when four pixels are treated as a single pixel.

However, if dither coefficients are added to the pixel data, picture quality could be impaired because the so-called "dither noise" i.e., spurious patterns having no relationship with the original pixel data, is perceived.

SUMMARY OF THE INVENTION

An object of the present invention is to provide a display device that can display excellent images with reduced dither noise.

According to one aspect of the present invention, there is provided a display device for displaying an image in response to a video (image) signal on a display screen, with a plurality of display cells being provided as pixels in the display screen, the display device comprising: a dither coefficient generator for generating dither coefficients for respective pixels in a pixel group such that the dither coefficients are allotted to respective pixel positions in the pixel group; a dither adder for adding the dither coefficients to respective pixel data, each pixel data corresponding to each pixel in the pixel group, derived from the video signal to obtain dither-added pixel data; and a display drive for causing the display cells to emit light with brightness corresponding to the respective dither-added pixel data; wherein the dither coefficient generator alters values of the dither coefficients between when a brightness level of the image displayed by the pixel data is of lower brightness than a prescribed brightness and when the brightness level of the image is falls within a prescribed intermediate brightness range.

The values of the dither coefficients employed in dither processing are altered when the brightness of the image to be displayed is low brightness and when it is intermediate brightness. Therefore, high quality image display with reduced dither noise is realized.

BRIEF DESCRIPTION OF THE DRAWINGS

FIG. 8 is a diagram illustrating a conversion table and light emission drive pattern of a second data conversion circuit shown FIG. 2;

DETAILED DESCRIPTION OF THE INVENTION

Embodiments of the present invention is described below with reference the drawings.

Figure 1:
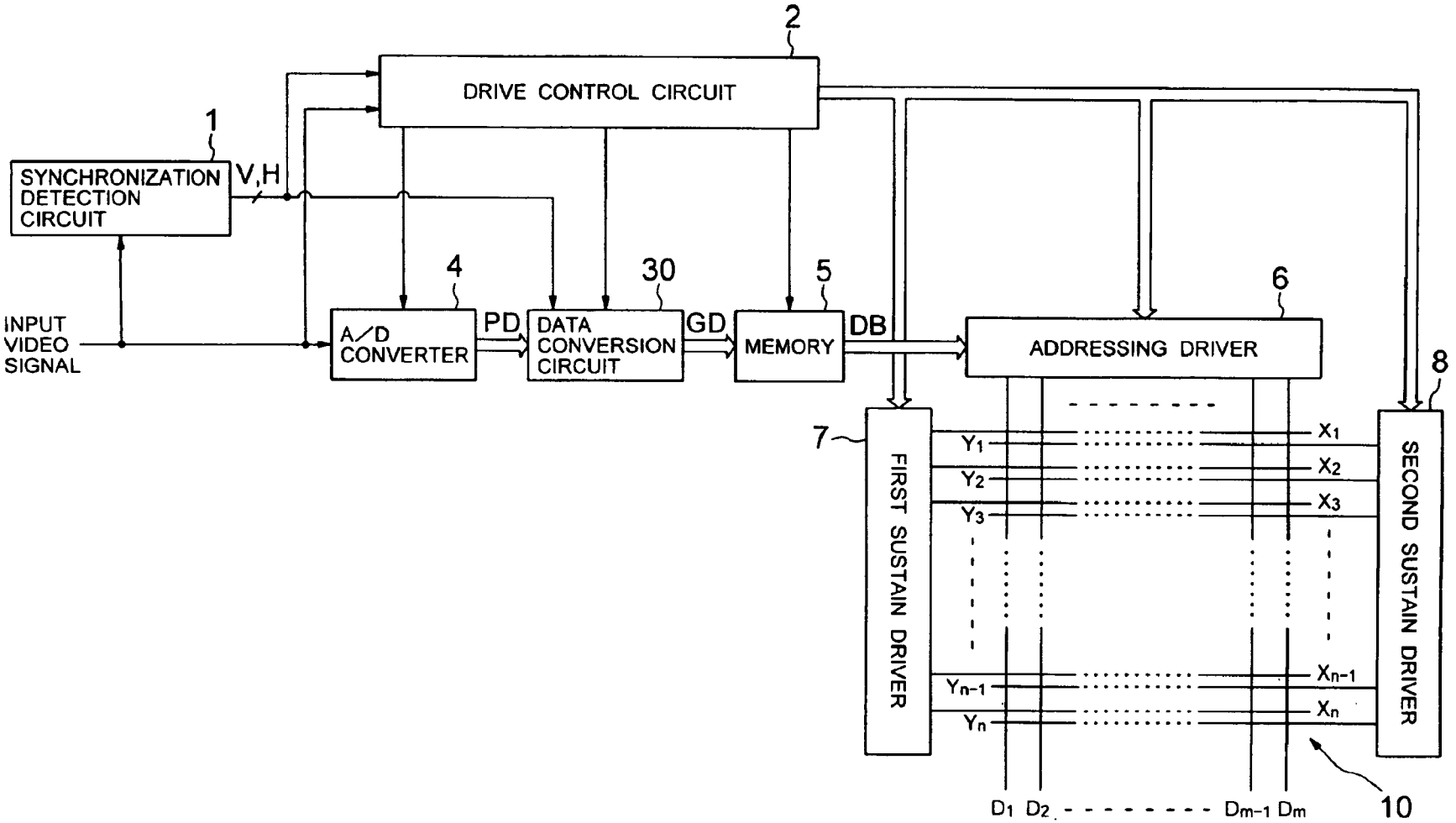
FIG. 1 illustrates the diagrammatic layout of a plasma display device, which is an example of a display device according to one embodiment of the present invention.

Referring to FIG. 1, illustrated is a diagrammatic layout of a display device according to one embodiment of the present invention.

The display device illustrated in FIG. 1 is a plasma display device including a plasma display panel as a display module (unit). This display device includes a PDP (plasma display panel) 10 and a drive section. The drive section includes a synchronization detection circuit 1, drive control circuit 2, A/D converter 4, data conversion circuit 30, memory 5, address driver 6, first sustain driver 7 and second sustain driver 8.

PDP 10 includes column electrodes D1 to Dm constituting address electrodes and row electrodes X1 to Xn and row electrodes Y1 to Yn arranged orthogonally with respect to the column electrodes. In PDP 10, a pair of row electrodes (row electrode X and row electrode Y) define one display row (line). Discharge cells acting as pixels are formed at the intersections of the column electrodes D and row electrodes X and Y.

Synchronization detection circuit 1 generates a vertical synchronization signal V when it detects the vertical synchronization signal from the analogue video signal. In addition, synchronization detection circuit 1 generates a horizontal synchronization signal H when it detects the horizontal synchronization signal from this video signal. Synchronization detection circuit 1 supplies the vertical synchronization signal V and horizontal synchronization signal H respectively to drive control circuit 2 and data conversion circuit 30. Under the control of a clock signal supplied from drive control circuit 2, A/D converter 4 samples the video signal and supplies this to data conversion circuit 30 after conversion to for example 10-bit pixel data PD for each pixel.

Figure 2:
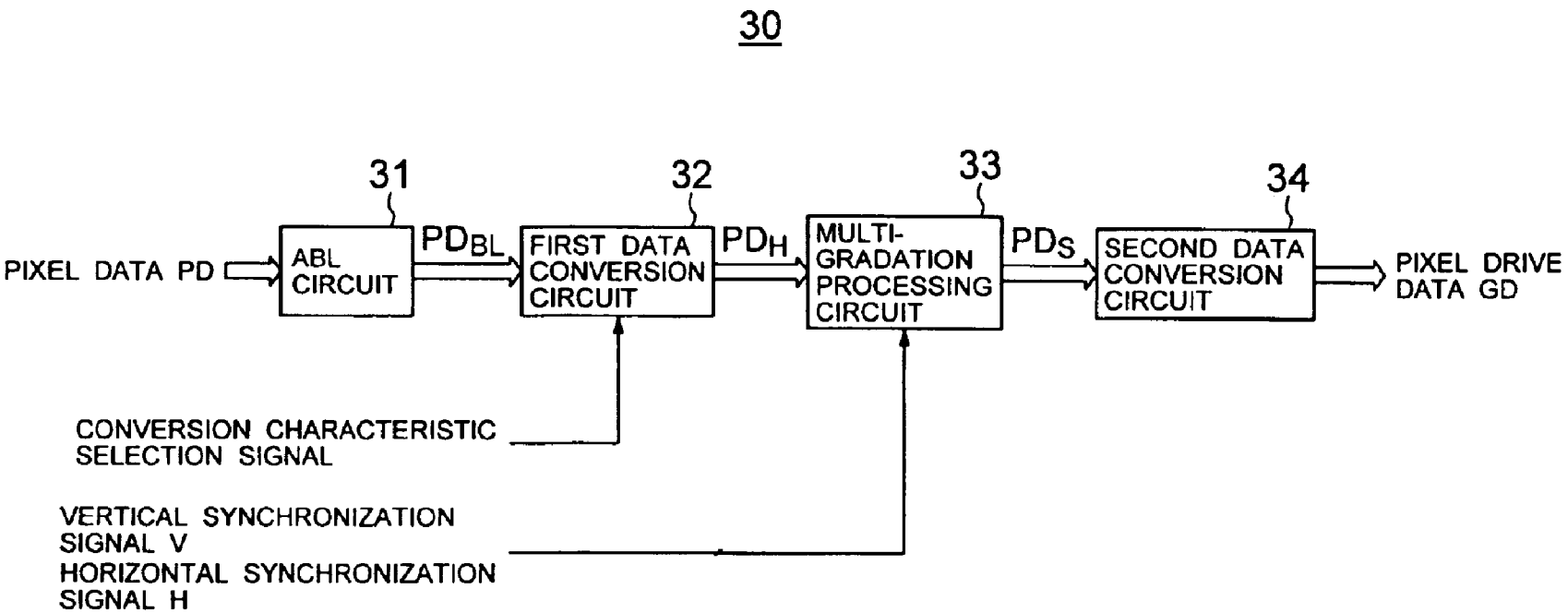
FIG. 2 illustrates the internal layout of a data conversion circuit in the plasma display device shown in FIG. 1.

FIG. 2 illustrates the internal layout of the data conversion circuit 30.

As shown in FIG. 2, data conversion circuit 30 includes an ABL (automatic brightness control) circuit 31, first data conversion circuit 32, multi-gradation processing circuit 33 and a second data conversion circuit 34.

ABL circuit 31 uses the pixel data PD (=input video signal) to find (decide) the average brightness of the image to be displayed on the screen of PDP 10 and adjusts the brightness level of the pixel data PD such that this average brightness lies within a suitable brightness range.

Figure 3:
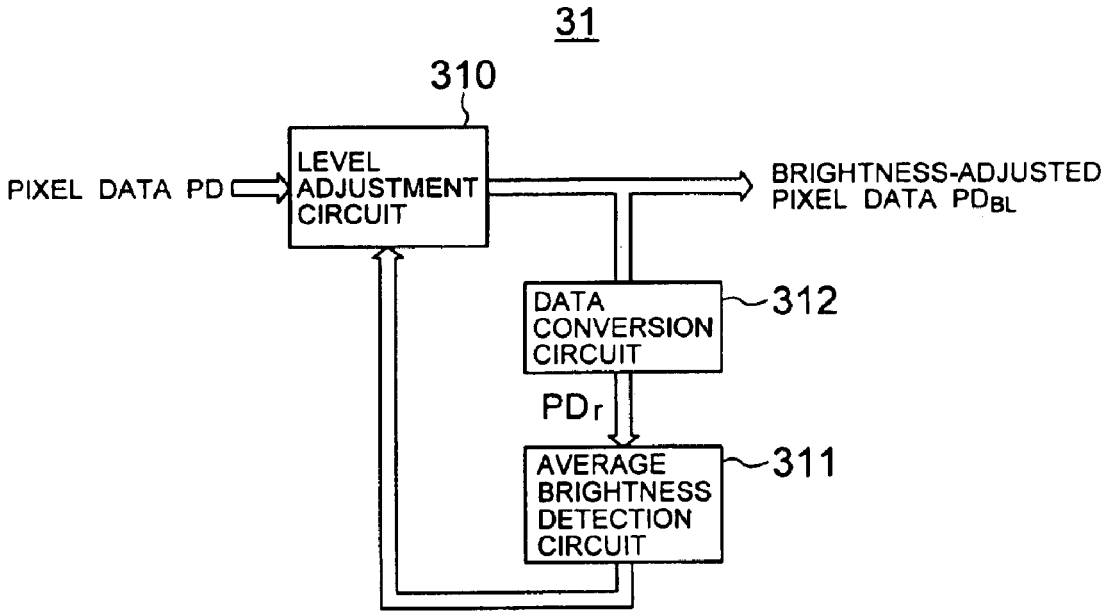
FIG. 3 illustrates the internal layout of an ABL circuit illustrated in FIG. 2.

FIG. 3 illustrates the internal layout of this ABL circuit 31.

Figure 4:
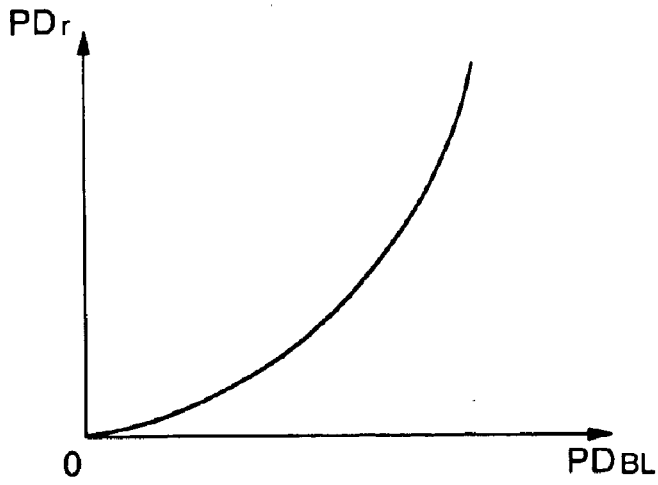
FIG. 4 illustrates a conversion characteristic curve used in a data conversion circuit shown in FIG. 3.

In FIG. 3, level adjustment circuit 310 adjusts the level of the pixel data PD in accordance with the average brightness information found by average brightness detection circuit 311, to be described, and outputs brightness-adjusted pixel data PDBL which is thereby obtained. As shown in FIG. 4, data conversion circuit 312 converts the brightness-adjusted pixel data PDBL into data of an inverse gamma characteristic (Y=X2.2) having a non-linear characteristic (i.e., the curve shown in FIG. 4) and supplies this to a average brightness level detection circuit 311 as inverse gamma-converted pixel data PDr. That is, pixel data (inverse gamma-converted pixel data PDr) corresponding to the original video signal from which gamma correction has been removed is recovered by performing inverse gamma correction processing on the brightness-adjusted circuit 311 finds the average brightness based on inverse gamma-converted pixel data PDr, and supplies this as the average brightness information to level adjustment circuit 310. Specifically, level adjusting circuit 310 supplies data obtained by adjusting the brightness level of the pixel data PD using this average brightness information to the conversion circuit 32 as the brightness-adjusted pixel data PDBL.

Figure 5:
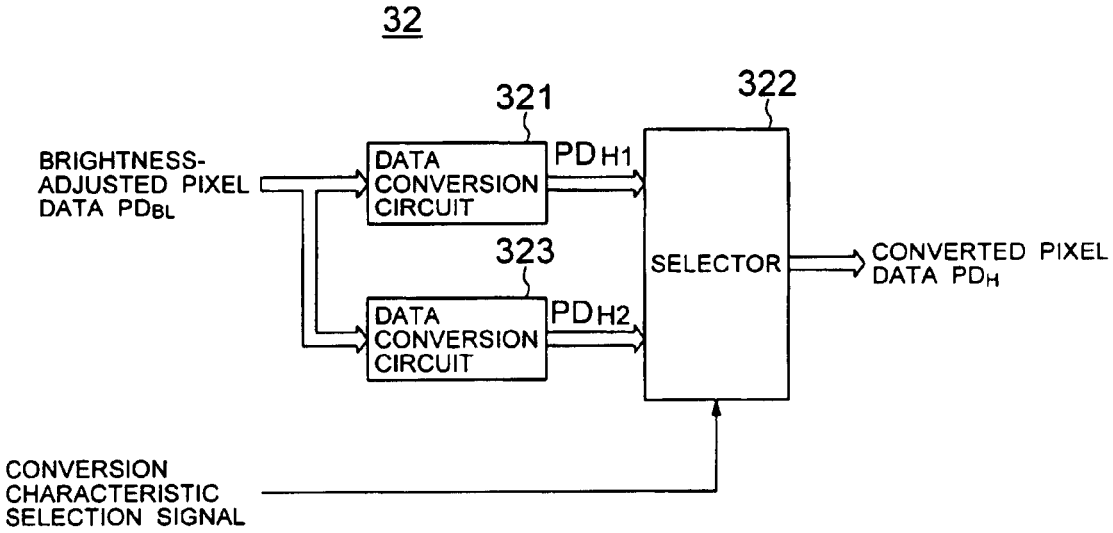
FIG. 5 illustrates the internal layout of a first data conversion circuit shown in FIG. 2.

FIG. 5 shows the internal layout of the first data conversion circuit 32.

Figure 6:
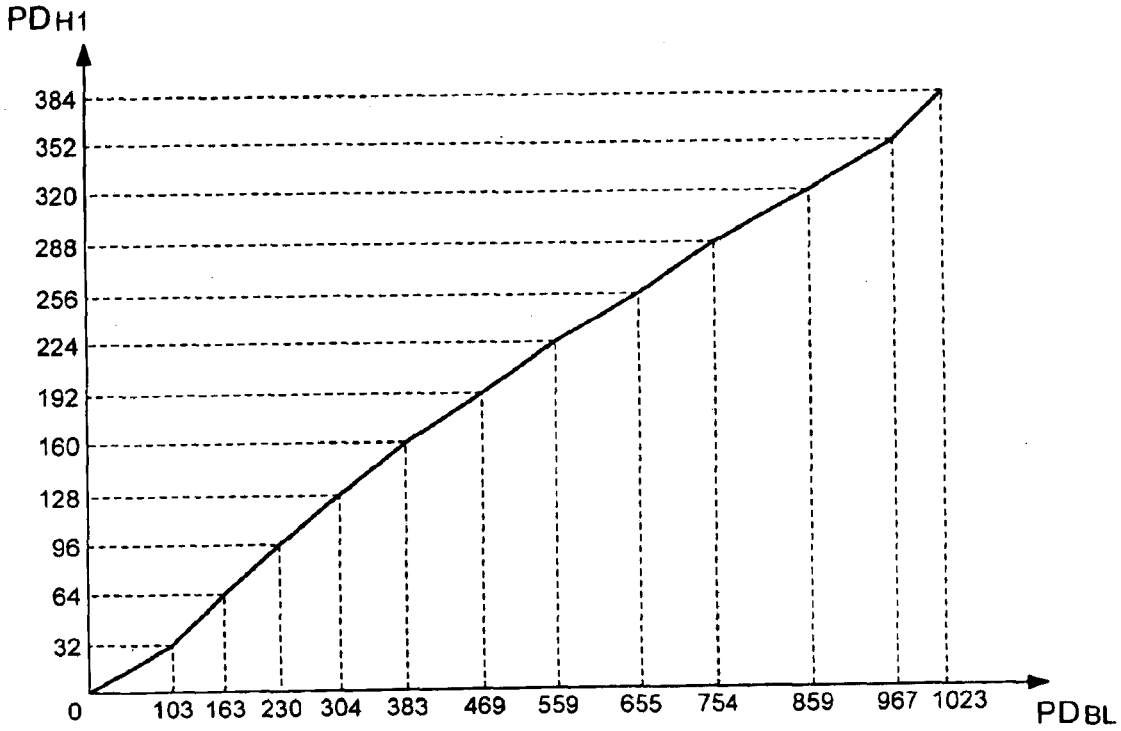
FIG. 6 is a diagram illustrating the data conversion characteristic curve used in a data conversion circuit shown in FIG. 5.
Figure 7:
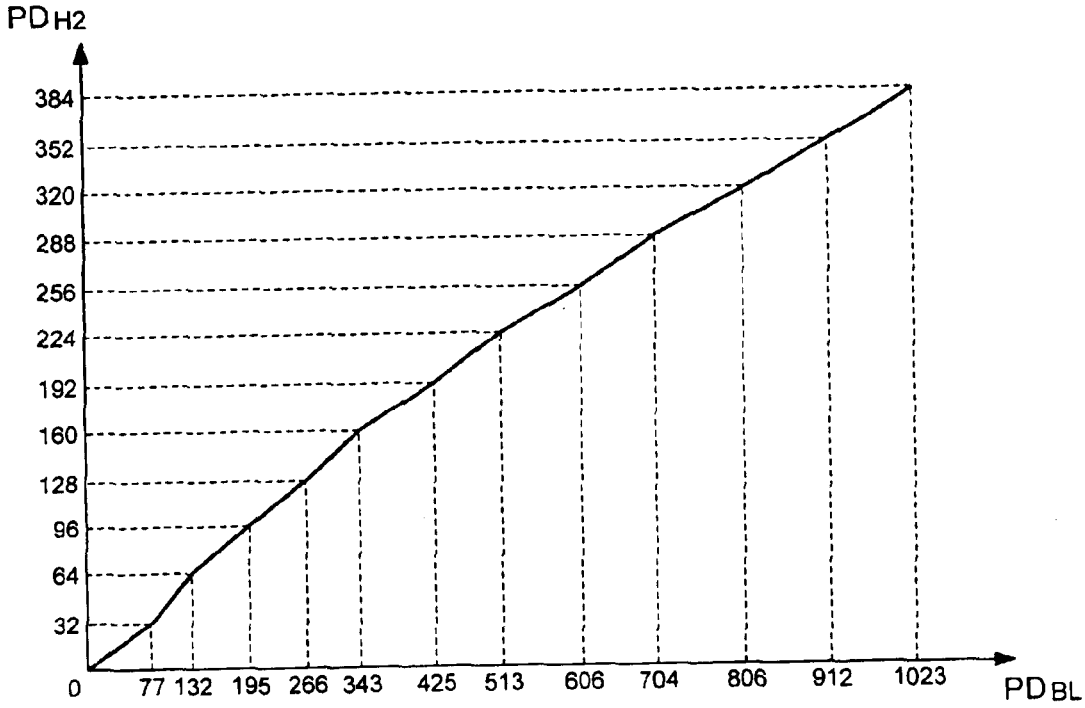
FIG. 7 is a diagram illustrating the data conversion characteristic curve used in another data conversion circuit shown in FIG. 5.

In FIG. 5, data conversion circuit 321 converts the brightness-adjusted pixel data PDBL which can represent "0" to "1024" by 10 bits into 9-bit brightness-converted pixel data PDH1 "0" to "384" in accordance with a conversion characteristic shown in FIG. 6 and supplies the pixel data PDH1 to selector 322. Data conversion circuit 323 converts the brightness-adjusted pixel data PDBL into brightness-converted pixel data PDH2 of 9 bits "0" to "384" in accordance with the conversion characteristic shown in FIG. 7 and supplies this pixel data PDH2 to selector 322. The conversion characteristics shown in FIG. 6 and FIG. 7 are different from each other in a conversion characteristic at brightness level lower than a prescribed brightness and a conversion characteristic in a prescribed intermediate brightness level range. Selector 322 selects one of the brightness-converted pixel data PDH1 and PDH2 in accordance with the logic level of a conversion characteristic selection signal and supplies the selected pixel data to multi-gradation processing circuit 33 as brightness-converted pixel data PDH. The conversion characteristic selection signal is supplied from drive control circuit 2.

The data conversion performed by first data conversion circuit 32 suppresses brightness saturation caused upon the multi-gradation processing of multi-gradation processing circuit 33, and generation of a flattened portion of the display characteristic produced when display gradation does not occur at the bit boundaries (i.e. generation of gradation distortion).

Multi-gradation processing circuit 33 generates multi-gradation pixel data PDS in which, while maintaining the current number of gradations, the bit number is reduced to four bits, by performing error diffusion processing and dither processing on the 9-bit brightness-converted pixel data PDH. This error diffusion processing and dither processing will be described later.

Second data conversion circuit 34 converts this 4-bit multi-gradation pixel data PDS into pixel drive data GD comprising first to twelfth bits in accordance with a conversion table as shown in FIG. 8 and supplies this drive data GD to memory 5.

In memory 5 there is successively written and stored the pixel drive data GD, in accordance with a write signal supplied from drive control circuit 2. When this write action completes the writing of pixel drive data GD11 to GDnm corresponding to a single screen (n rows and m columns), memory 5 sequentially reads respective pixel drive data GD11 to GDnm in accordance with a read signal supplied from drive control circuit 2 at each row and at the same bit place, and supplies them to address driver 6. Specifically, first of all, memory 5 takes the pixel drive data GD11 to GDnm of one screen as the 12 pixel drive data bit groups DB1 to DB12:

DB111 to DB1*nm*: first bits of pixel drive data GD11 to GDnm

DB211 to DB2*nm*: second bits of pixel drive data GD11 to GDnm

DB311 to DB3*nm*: third bits of pixel drive data GD11 to GDnm

DB411 to DB4*nm*: fourth bits of pixel drive data GD11 to GDnm

DB511 to DB5*nm*: fifth bits of pixel drive data GD11 to GDnm

DB611 to DB6*nm*: sixth bits of pixel drive data GD11 to GDnm

DB711 to DB7*nm*: seventh bits of pixel drive data GD11 to GDnm

DB811 to DB8*nm*: eighth bits of pixel drive data GD11 to GDnm

DB911 to DB9*nm*: ninth bits of pixel drive data GD11 to GDnm

DB1011 to DB10*nm*: tenth bits of pixel drive data GD11 to GDnm

DB1111 to DB11*nm*: eleventh bits of pixel drive data GD11 to GDnm

DB1211 to DB12*nm*: twelfth bits of pixel drive data GD11 to GDnm

Memory 5 then reads the respective drive data bit groups DB1 to DB12 with the timings of respective subfields SF1 to SF12, to be described, and supplies them to address driver 6. For example, in the case of subfield SF1, memory 5 reads one display line at a time of pixel drive data bit groups DB111 to DB1*nm* and supplies these to address driver 6. Also, in the case of subfield SF12, memory 5 reads one display line at a time of pixel drive data bit groups DB1211 to DB12*nm* and supplies these to address driver 6.

Figure 9A:
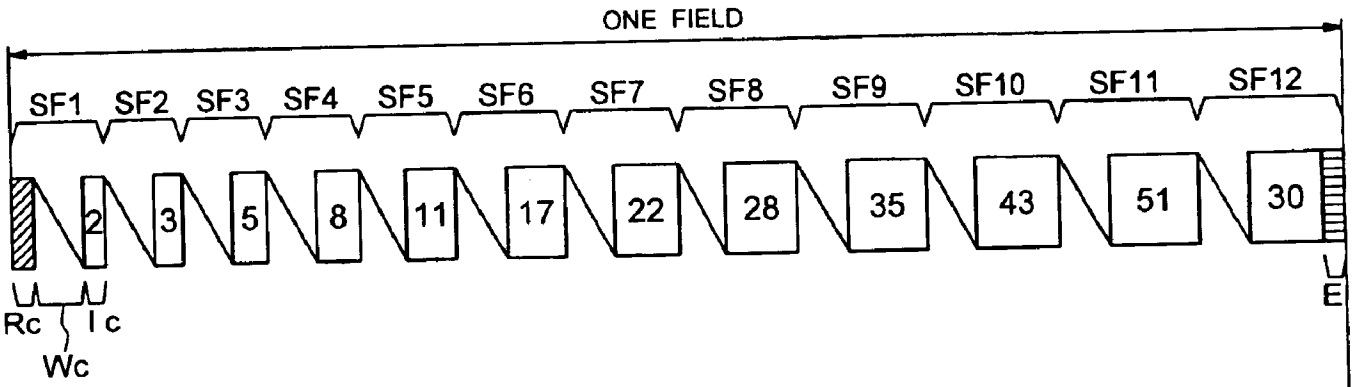
FIG. 9A illustrates a first light emission drive format employed in the plasma display device shown in FIG. 1.
Figure 9B:
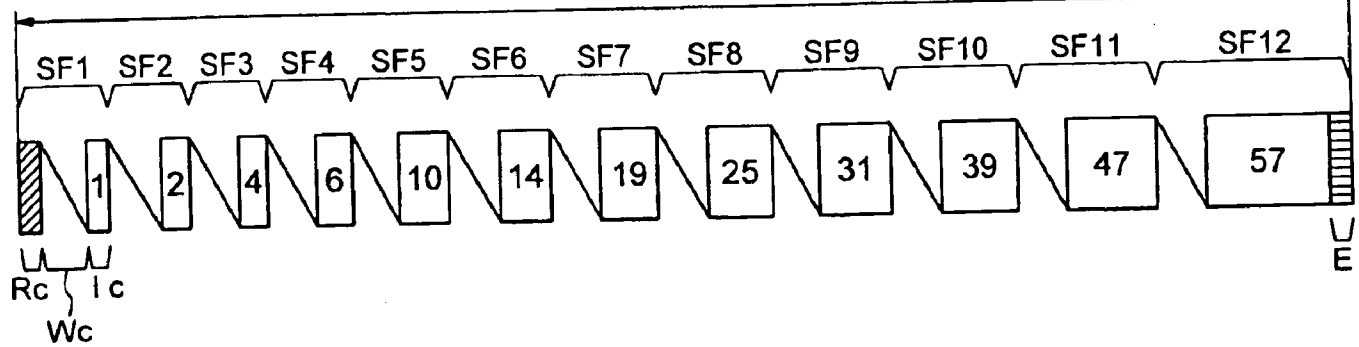
FIG. 9B illustrates a second light emission drive format employed in the plasma display device shown in FIG. 1.

Drive control circuit 2 alternately adopts a first light emission drive format shown in FIG. 9A and a second light emission drive format shown in FIG. 9B every time vertical synchronization signal V is supplied from synchronization detection circuit 1. When the first light emission drive format is adopted, drive control circuit 2 supplies to first data conversion circuit 32 a conversion characteristic selection signal such that data conversion is to be performed in accordance with the conversion characteristic shown in FIG. 6. On the other hand, when the second light emission drive format is adopted, drive control circuit 2 supplies to first data conversion circuit 32 a conversion characteristic selection signal such that data conversion is to be performed in accordance with the conversion characteristic shown in FIG. 7.

In addition, various timing signals such as to drive PDP 10 in accordance with the light emission drive formats selected as described above are supplied by drive control circuit 2 to address driver 6, first sustain driver 7 and second sustain driver 8. Specifically, drive control circuit 2 effects gradation drive of PDP 10 in accordance with the first light emission drive format shown in FIG. 9A for example in the case of odd-numbered fields in the input video signal and effects gradation drive of PDP 10 in accordance with the second light emission drive format shown in FIG. 9B for example in the case of even-numbered fields in the input video signal.

In the light emission drive format shown in FIG. 9A and FIG. 9B, a single field period in the video signal is divided into twelve subfields SF1 to SF12, and drive of PDP 10 is effected for each of the twelve subfields SF1 to SF12. Each subfield includes an addressing step Wc in which the discharge cells of PDP 10 are set in accordance with the input video signal to either a "light emission discharge cell" condition or an "extinguished discharge cell" condition, and a light emission sustaining step Ic in which light emission, only from those discharge cells which are in the "light emission discharge cell" condition, is provoked for a period (number of times) corresponding to the weighting of each subfield. In the case of the first light emission drive format shown in FIG. 9A, light emission from the discharge cells in the "light emission discharge cell" condition is continued only for the following periods (number of times) in the light emission sustaining step Ic of the respective subfields SF1 to SF12:

SF1: 2
SF2: 3
SF3: 5
SF4: 8
SF5: 11
SF6: 17
SF7: 22
SF8: 28
SF9: 35
SF10: 43
SF11: 51
SF12: 30

In contrast, in the case of the second light emission drive format shown in FIG. 9B, light emission from the discharge cells in the "light emission discharge cell" condition is continued only for the following periods (number of times) during the light emission sustaining step Ic of the respective subfields SF1 to SF12:

SF1: 1
SF2: 2
SF3: 4
SF4: 6
SF5: 10
SF6: 14
SF7: 19
SF8: 25

SF9: 31

SF10: 39

SF11: 47

SF12: 57

Furthermore, in both the first and second light emission drive formats, a simultaneous reset step Rc is executed to initialize all of the discharge cells of PDP 10 to the "light emission discharge cell" condition in only the leading subfield SF1, and an extinguishing step E is executed to put all of the discharge cells into the "extinguished" condition in only the last subfield SF8.

Figure 10:
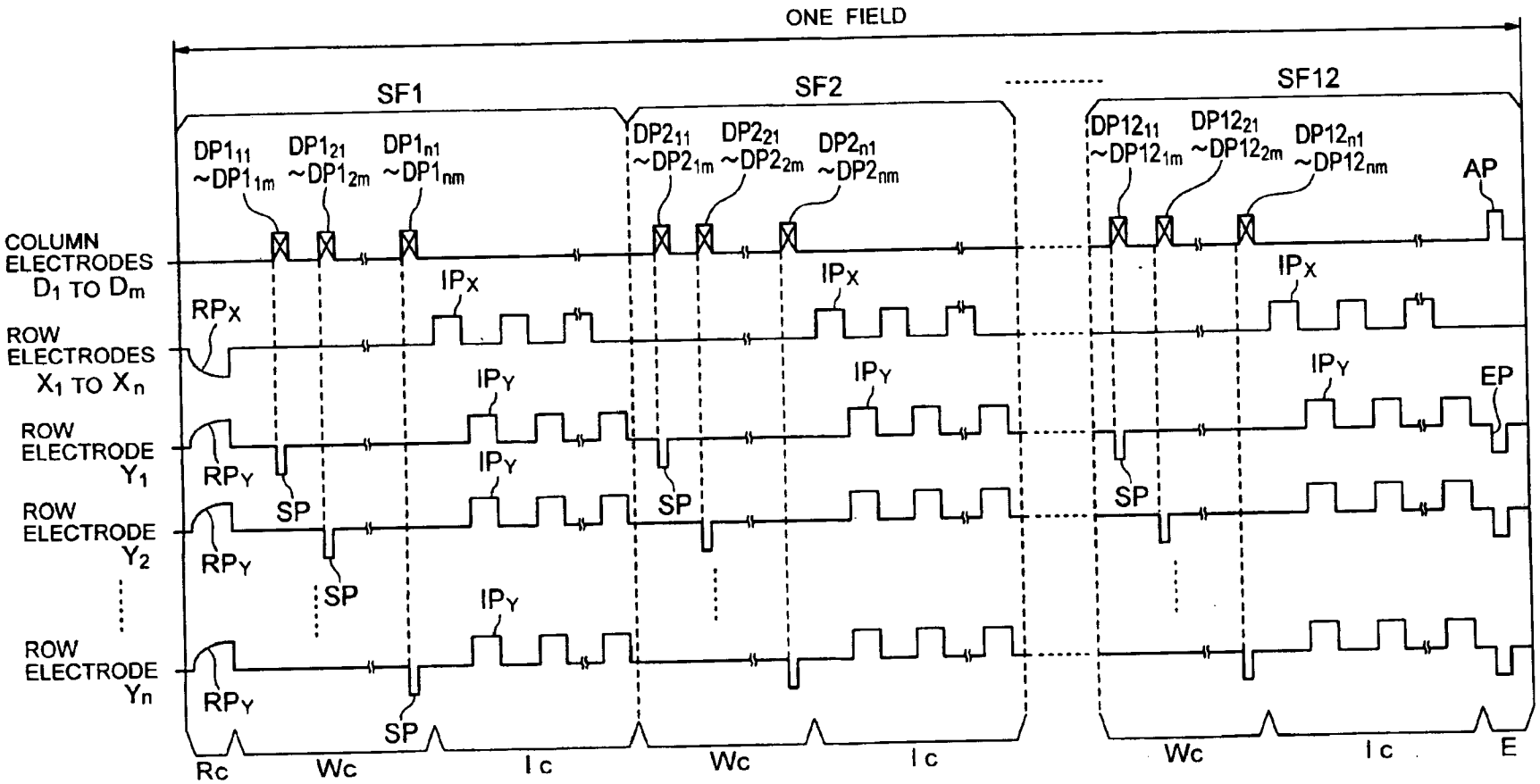
FIG. 10 illustrates various drive pulses applied to the PDP in a single field, and the timing of these drive pulse application.

FIG. 10 is a diagram showing the timing of application of the various drive pulses from address driver 6, first sustain driver 7 and second sustain driver 8, respectively, to the row electrodes and column electrodes of PDP 10, in accordance with the light emission drive formats shown in FIG. 9A and FIG. 9B.

First, in the simultaneous reset step Rc of subfield SF1, first sustain driver 7 applies a reset pulse RPX of negative polarity as shown in FIG. 10 to row electrodes X1 to Xn. Simultaneously with the application of this reset pulse RPX, second sustain driver 8 applies a reset pulse RPY of positive polarity as shown in FIG. 10 to the row electrodes Y1 to Y2. In response to application of these reset pulses RPX and RPY, all of the discharge cells of PDP 10 are subjected to reset discharge (cause the reset discharge), with the result that a wall charge of certain amount is uniformly formed in each discharge cell. All of the discharge cells are thereby initialized into the "light emission discharge cell" condition.

Next, in the addressing step Wc of each of the subfields, address driver 6 generates a pixel data pulse having a voltage corresponding to the logic level of pixel drive data bit DB that is supplied from memory 5. For example, if the pixel drive data bit DB is logic level "1", address driver 6 generates a high-voltage pixel data pulse; if it is "0", it generates a low-voltage (0 volt) pixel data pulse. Address driver 6 applies these pixel data pulses (m pulses) to column electrodes D1 to Dm for each row (display line).

For example, in the addressing step Wc of subfield SF1, pixel drive data bit groups DB111 to DB1*nm* are supplied from memory 5, so, first of all, address driver 6 extracts from these a portion corresponding to the first display line, i.e., DB111 to DB11*m*. Address driver 6 then converts these m DB111 to DB11*m*, respectively, to m pixel data pulses DP111 to DP11*m* on the basis of their logic levels, and applies these simultaneously to column electrodes D1 to Dm as shown in FIG. 10. Next, address driver 6 extracts DB121 to DB12*m*, which corresponds to the second display line, from the pixel drive data bit groups DB111 to DB1*nm*. Address driver 6 then converts these m DB121 to DB12*m*, respectively, to m pixel data pulses DP121 to DP12*m* on the basis of their logic levels, and applies these simultaneously to column electrodes D1 to Dm as shown in FIG. 10. Likewise pixel data pulse application takes place thereafter in the addressing step Wc of subfield SF1; in each time, address driver 6 applies one display line worth of pixel data pulses DP1, which corresponds to the pixel drive data bit group DB1 supplied from memory 5, to column electrodes D1 to Dm.

In the addressing step Wc, second sustain driver 8 generates a scanning pulse SP of negative polarity as shown in FIG. 10 with the same timing as the application timing of pixel data pulse group DP for each single row (display line), and sequentially applies the scanning pulse SP to row electrodes Y1 to Yn. When this is done, discharge (selective elimination (deletion, erasure) discharge) occurs exclusively at the discharge cells at the intersections of row electrodes to which scanning pulse SP is applied and column electrodes to which high-voltage pixel data pulses are applied, thereby causing the residual wall charge in such discharge cells to be (selectively) eliminated. By this selective elimination discharge, the discharge cells that are initialized to the "the light emission discharge cell condition" in the simultaneous reset step Rc are changed to the "the extinguished discharge cell condition". In contrast, discharge cells in which this selective elimination discharge is not provoked maintain their immediately previous condition. That is, discharge cells which are in the "the light emission discharge cell condition" are set to remain in the "the light emission discharge cell condition", while discharge cells which are in the "the extinguished discharge cell condition" are set to remain in the "the extinguished discharge cell condition".

Next, in the light emission maintenance step Ic of each subfield, first sustain driver 7 and second sustain driver 8 respectively apply maintenance pulses IPX and IPY of positive polarity alternately as shown in FIG. 8 to the row electrodes X1 to Xn and Y1 to Yn.

While drive is being executed in accordance with the first light emission drive format shown in FIG. 9A, the number of times that the maintenance pulse IP is applied in the light emission maintenance step Ic is as follows:

SF1: 2

SF2: 3

SF3: 5

SF4: 8

SF5: 11

SF6: 17

SF7: 22

SF8: 28

SF9: 35

SF10: 43

SF11: 51

SF12: 30

While the drive is being executed in accordance with the second light emission drive format shown in FIG. 9B, it is:

SF1: 1

SF2: 2

SF3: 4

SF4: 6

SF5: 10

SF6: 14

SF7: 19

SF8: 25

SF9: 31

SF10: 39

SF11: 47

SF12: 57

Thus, only the discharge cells that still have wall charge remaining i.e., only the discharge cells that are set to "the light emission discharge cell condition" in addressing step Wc, perform maintenance discharge every time the maintenance pulses IPX and IPY are applied. Consequently, the discharge cells that are set to "the light emission discharge cell condition" maintain light emission, caused by this maintenance discharge, for the number of discharge times allocated to each subfield.

An elimination step E is then executed, solely in the final subfield SF8. In this elimination step E, address driver 6 generates an elimination pulse AP of positive polarity as shown in FIG. 10 and applies the elimination pulse AP to column electrodes D1 to Dm. In addition, second sustain driver 8 generates an elimination pulse EP of negative polarity as shown in FIG. 10 simultaneously with the timing of application of the elimination pulse AP and applies the elimination pulse EP to row electrodes Y1 to Yn. By the simultaneous application of these elimination pulses AP and EP, elimination discharge is provoked in all of the discharge cells in PDP 10, with the result that the wall charges remaining in all of the discharge cells are erased. By means of this elimination discharge, all of the discharge cells in PDP 10 are shifted to the "extinguished discharge cell condition".

With the drive schemes shown in FIGS. 9A, 9B and 10, only discharge cells that are set in the "the light emission discharge cell condition" in addressing step Wc in each subfield repeat the light emission produced by the discharge for a number of times as described above in the light emission maintenance step Ic immediately thereafter.

Whether a discharge cell is set to the "the light emission discharge cell condition" or the "the extinguished discharge cell condition" is determined by the pixel drive data GD, as shown in FIG. 8. Specifically, if the bits of pixel drive data GD are at logic level "1", selective elimination discharge is provoked in addressing step Wc of the subfield corresponding to the bit place in question, and the discharge cell is set to "the extinguished discharge cell condition". In contrast, if the bit logic level is "0", the selective elimination discharge is not provoked, so the current condition is maintained. That is, discharge cells that are in the "the extinguished discharge cell condition" immediately prior to this addressing step Wc maintain the "the extinguished discharge cell condition", and discharge cells that are in the "the light emission discharge cell condition" maintain the "the light emission discharge cell condition". In this case, of the first to twelfth bits in the 13 pixel drive data GD shown in FIG. 8, a maximum of one bit is at logic level "1". Specifically, with the pixel drive data GD as shown in FIG. 8, it is impossible for selective elimination discharge to be produced more than once in a single field period. Furthermore, with the light emission drive formats shown in FIG. 9A and FIG. 9B, the opportunity for a discharge cell to shift from "the extinguished discharge cell condition" to a "the light emission discharge cell condition" is only presented in the simultaneous reset step Rc of the leading subfield SF1.

Consequently, when drive is performed in accordance with the light emission drive format shown in FIG. 9A or FIG. 9B using the pixel drive data GD shown in FIG. 8, each discharge cell is in the "the light emission discharge cell condition" from the head of one field until the selection elimination discharge is generated in the subfield marked with a black circle in FIG. 8. Thus, light emission from the discharge cell caused by the maintenance discharge is repeated for the number of times mentioned above in the light emission maintenance step Ic of the respective subfields indicated by the white circles that are present between the field head and the black circle. Thus, brightness of an intermediate (grayscale) level is perceived corresponding to the total number of maintenance discharge light emissions executed in subfields SF1 to SF12 in a single field period.

In the case of odd-numbered fields, since drive is performed in accordance with the first light emission drive format shown in FIG. 9A, intermediate brightness with 13 gradations is then represented, as shown in FIG. 8, having respective (13) light emission brightness in accordance with the 13 types of pixel drive data GD. The 13 brightness is:

[0: 2: 5: 8: 18: 29: 46: 68: 96: 131: 174: 225: 255]

In contrast, in the case of even-numbered fields, since drive is performed in accordance with the second light emission drive format shown in FIG. 9B, another intermediate brightness with another 13 gradations is represented, as also shown in FIG. 8, having respective (13) light emission brightness in accordance with the 13 types of pixel drive data GD. The 13 brightness is:

[0: 1: 3: 7: 13: 23: 37: 56: 81: 112: 151: 198: 255].

In sum, drive with 13 gradations of two types with mutually different periods of light emission to be performed in each subfield is alternately executed in each field (frame).

Figure 11:
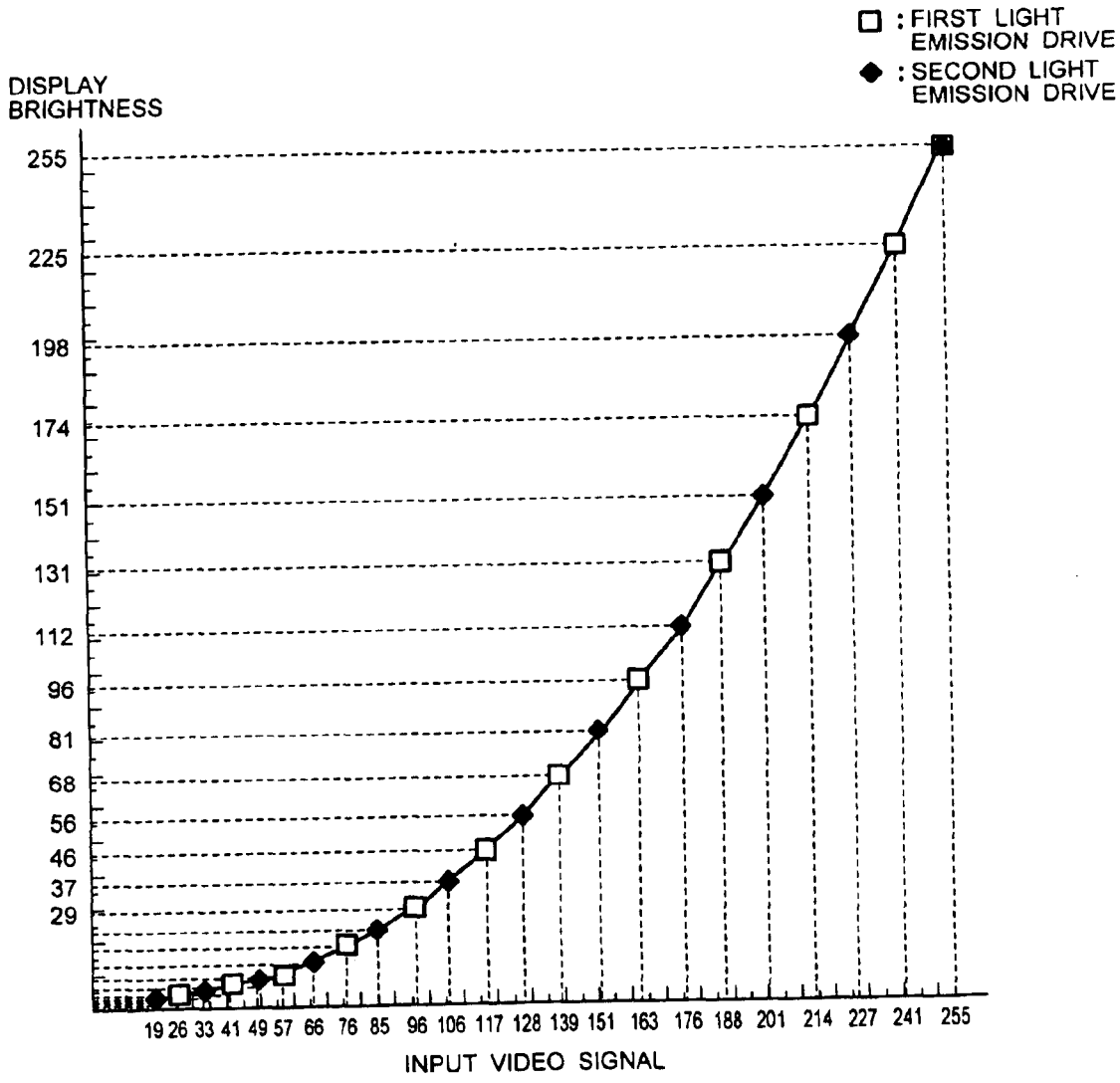
FIG. 11 is a diagram illustrating light emission brightngess with thirteen gradations when driving the PDP in accordance with the first light emission drive format shown in FIG. 9A and the light emission brightness with thirteen gradations when driving the PDP in accordance with the second light emission drive format shown in FIG. 9B.

FIG. 11 is a diagram showing the light emission brightness with 13 respective gradations when drive is executed in accordance with the first light emission drive format and the light emission brightness with 13 respective gradations when drive is executed in accordance with the second light emission drive format. In FIG. 11, the symbols □ indicate the light emission brightness in accordance with the first light emission drive format and the symbols ♦ indicate light emission brightness in accordance with the second light emission drive format. From this diagram, it can be seen that, when the drive pattern i.e., the number of times of light emission (number of maintenance pulses) in the maintenance light emission step Ic of each subfield is altered for each field (frame), in between respective brightness of 13 gradations represented by one type of drive, there are inserted brightness of 13 gradations represented by another type of drive. Consequently, due to the integration effect in the time direction, the number of display gradations perceived is increased to more than 13 gradations, thereby improving the ability to represent gradations.

As shown in FIG. 11, the brightness between adjacent gradations is represented by multi-gradation processing such as error diffusion processing or dither processing.

Figure 12:
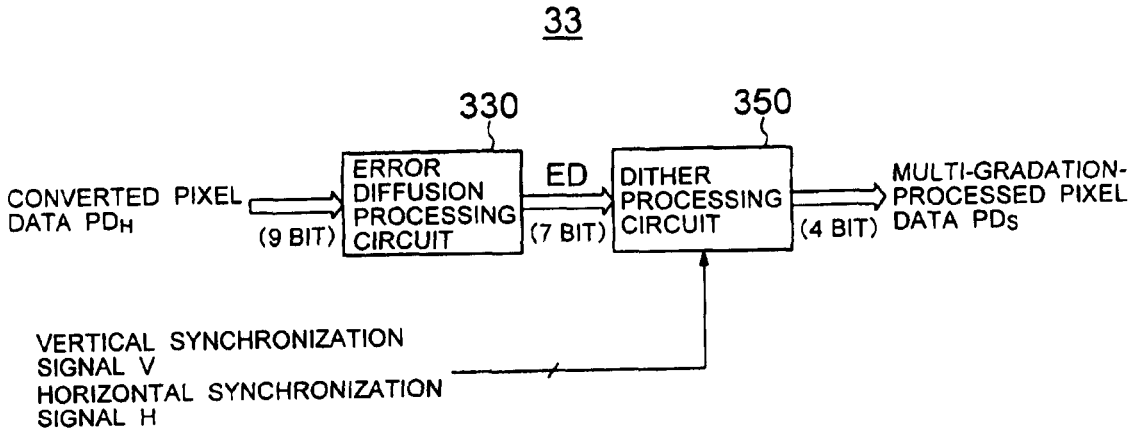
FIG. 12 illustrates the internal layout of a multi-gradation processing circuit shown in FIG. 2.

FIG. 12 illustrates the internal layout of multi-gradation processing circuit 33 that executes the error diffusion processing and dither processing.

As shown in FIG. 12, multi-gradation processing circuit 33 includes an error diffusion processing circuit 330 and dither processing circuit 350.

Figure 13:
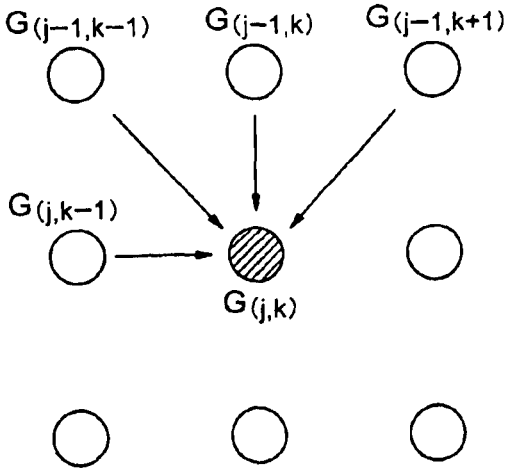
FIG. 13 is an illustration to explain the operation of an error diffusion processing circuit shown in FIG. 12.

Referring to FIG. 13, first of all, error diffusion processing circuit 330 extracts pixel data corresponding respectively to pixels G(j, k), G(j, k−1), G(j−1, k−1), G(j−1, k) and G(j−1, k+1) of the PDP 10 from the sequence of brightness-converted pixel data PDH that is supplied from first data conversion circuit 32. Then, the low bits (low brightness components) of the pixel data respectively corresponding to pixels G(j, k−1), G(j−1, k+1), G(j−1, k) and G(j−1, k−1) are subjected to weighted addition and the result thus obtained is reflected to the higher seven bits of the pixel data corresponding to pixel G(j, k). Error diffusion processing circuit 330 then supplies to dither processing circuit 350, the result thus obtained as error diffusion-processed pixel data ED. By the error diffusion processing, the low brightness component of the pixel data corresponding to pixel G(j, k) is expressed in simulated fashion by pixel data corresponding to the respective peripheral pixels. Therefore, even though the bit number of the error diffusion-processed pixel data ED is seven bits, brightness similar to that of 8 bits can be expressed.

Figure 14:
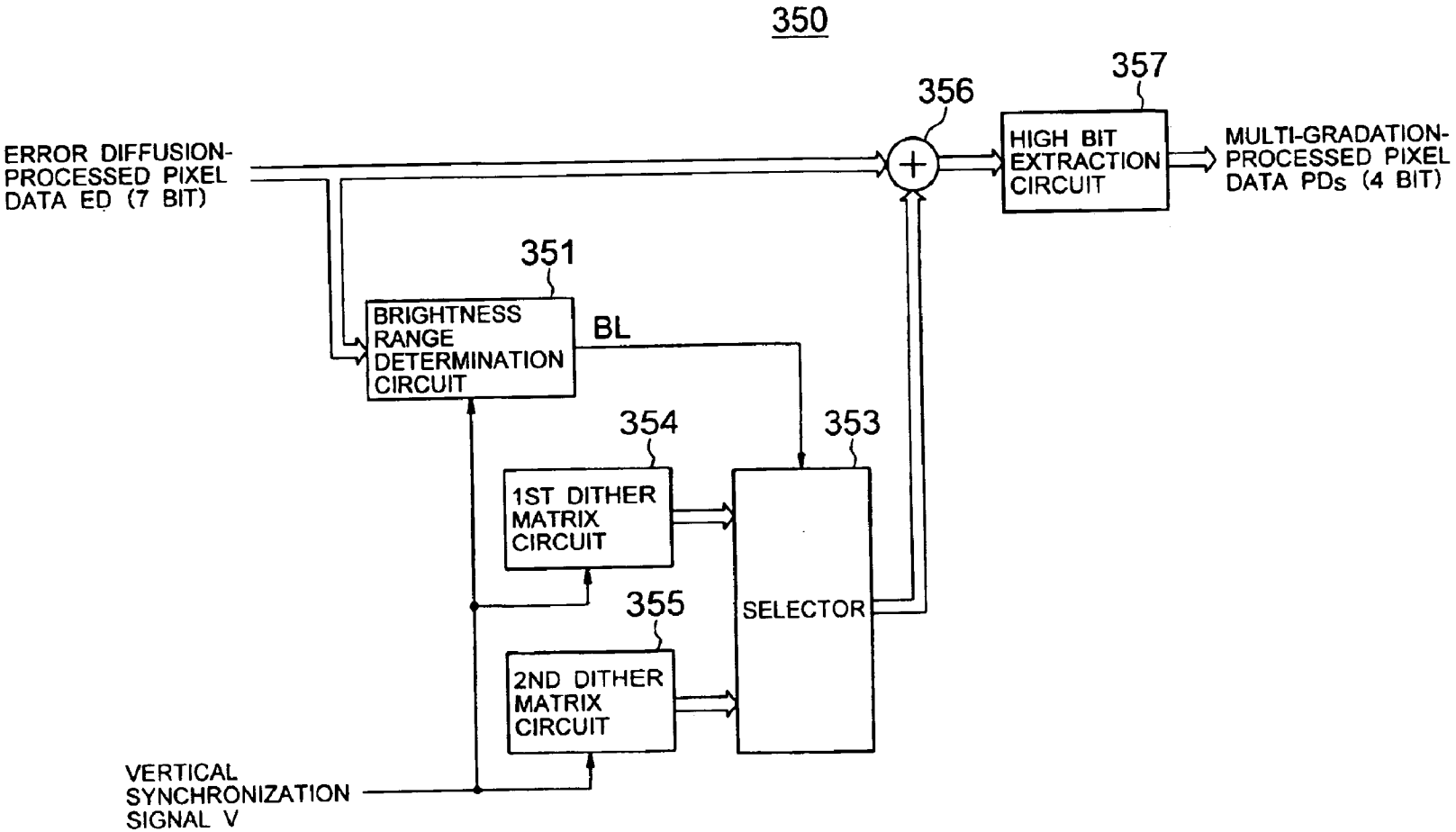
FIG. 14 illustrates the internal layout of a dither processing circuit shown in FIG. 12.

FIG. 14 illustrates the internal layout of dither processing circuit 350.

Dither processing circuit 350 includes brightness range identifying circuit 351, selector 353, first dither matrix circuit 354, second dither matrix circuit 355, adder 356 and high bit extraction circuit 357.

First, brightness range determination circuit 351 determines whether the brightness level expressed by the 7-bit error diffusion-processed pixel data ED is lower than a prescribed low brightness level (for example "7") or is in an intermediate brightness range (for example "8" to "88") or is higher than a prescribed high brightness level (for example is higher than "88"). If brightness range determination circuit 351 determines that the brightness level of the error diffusion-processed pixel data ED falls within the intermediate brightness range, brightness range determination circuit 351 supplies a brightness identifying signal BL of logic level "1" to selector 353. On the other hand, if brightness range determination circuit 351 determines that the brightness level of the error diffusion-processed pixel data ED is lower than the prescribed low brightness level, or that it is higher than the described high-brightness level, brightness range determination circuit 351 supplies to selector 353 a brightness identifying signal BL of logic level "0".

Figure 15:
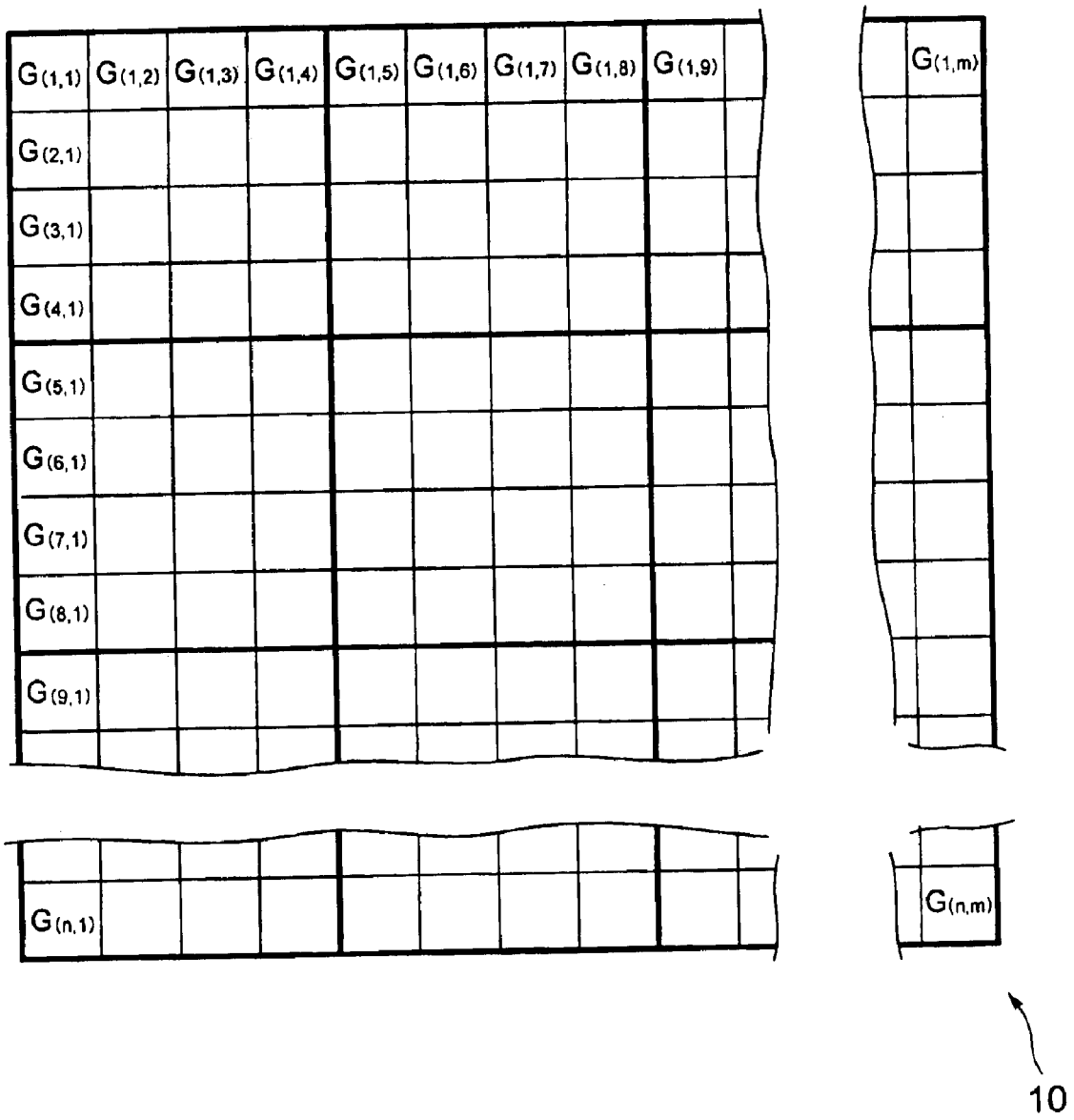
FIG. 15 is a diagram illustrating a pixel arrary in the PDP.

First dither matrix circuit 354 and a second dither matrix circuit 355 respectively generate 3-bit dither coefficients representing "0" to "7" corresponding to the pixel positions within each pixel group of 4 rows×4 columns of PDP 10 enclosed by thick lines in FIG. 15. The dither coefficients that are thus generated are then sent to selector 353 with a timing matching respectively the error diffusion-processed pixel data ED supplied corresponding to the pixel elements in the pixel group. It should be noted that although the first dither matrix circuit 354 and second dither matrix circuit 355 perform the same action in that they generate the dither coefficients "0" to "7", they differ in regard to the way in which they allocate the dither coefficients to the pixels in the 4 rows×4 columns pixel group.

Figure 16:
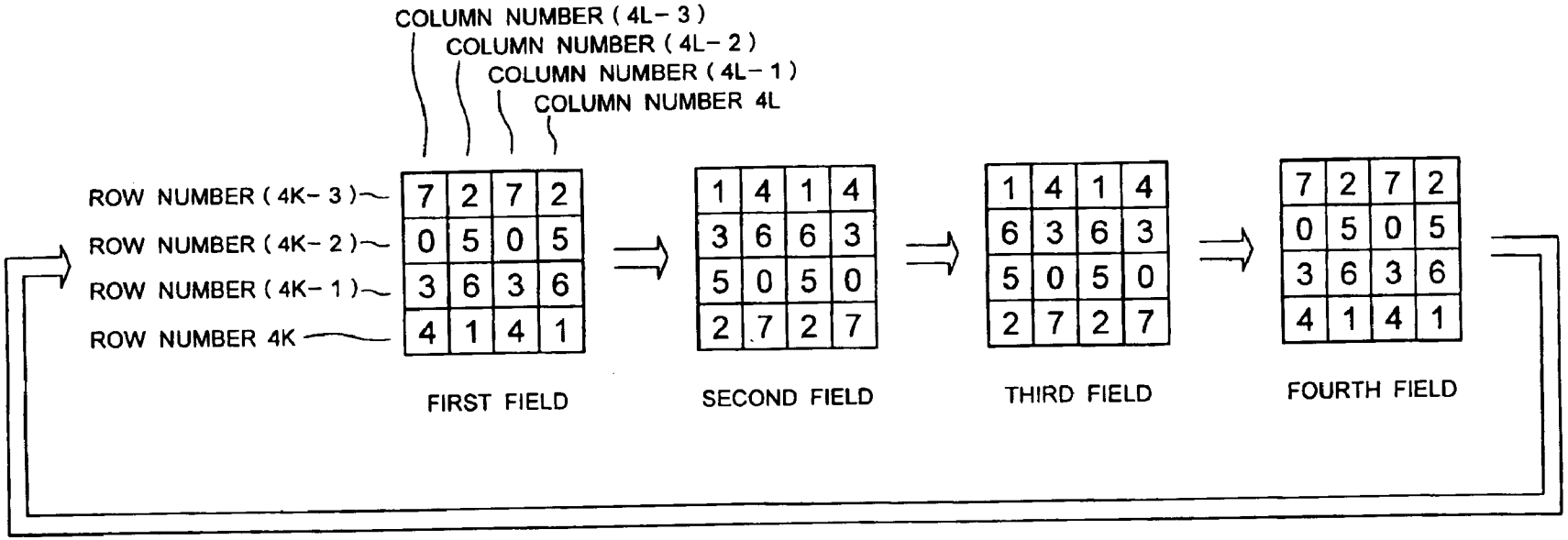
FIG. 16 illustrates four matrices (groups) of pixels, each consisting of four rows X four columns, with dither coeffcients generated by the first dither matrix circuit shown in FIG. 14 being allotted to the respective pixels.

FIG. 16 illustrates a dither matrix table showing the way in which the dither coefficients generated by the first dither matrix circuit 354 are allocated to the respective pixel positions.

As shown in FIG. 16, first dither matrix circuit 354, in the initial first field, generates dither coefficients

"7", "2", "7", "2"

corresponding to the respective pixels belonging to the column of number (4L-3), the column of number (4L-2), the column of number (4L-1) and the column of number 4L in the row of number (4K-3) of PDP 10. Here, K represents a natural number from 1 to n/4, and L represents a natural number from 1 to m/4.

In this first field, first dither matrix circuit 354 generates dither coefficients

"0", "5", "0", "5"

respectively corresponding to the pixels belonging to the column of number (4L-3), the column of number (4L-2), the column of number (4L-1) and the column of number 4L in the row of number (4K-2) of PDP 10.

In this first field, first dither matrix circuit 354 generates dither coefficients

"3", "6", "3", "6"

respectively corresponding to the pixels belonging to the column of number (4L-3), the column of number (4L-2), the column of number (4L-1) and the column of number 4L in the row of number (4K-1) of PDP 10.

In this first field, first dither matrix circuit 354 generates dither coefficients

"4", "1", "4", "1"

respectively corresponding to the pixels belonging to the column of number (4L-3), the column of number (4L-2), the column of number (4L-1) and the column of number 4L in the row of number 4K of PDP 10.

Next, in the second field, first dither matrix circuit 354 generates dither coefficients

"1", "4", "1", "4"

respectively corresponding to the pixels belonging to the column of number (4L-3), the column of number (4L-2), the column of number (4L-1) and the column of number 4L in the row of number (4K-3) of PDP 10.

In the second field, first dither matrix circuit 354 generates dither coefficients

"6", "3", "6", "3"

respectively corresponding to the pixels belonging to the column of number (4L-3), the column of number (4L-2), the column of number (4L-1) and the column of number 4L in the row of number (4K-2) of PDP 10.

In the second field, first dither matrix circuit 354 generates dither coefficients

"5", "0", "5", "0"

respectively corresponding to the pixels belonging to the column of number (4L-3), the column of number (4L-2), the column of number (4L-1) and the column of number 4L in the row of number (4K-1) of PDP 10.

In this second field, first dither matrix circuit 354 generates dither coefficients

"2", "7", "2", "7"

respectively corresponding to the pixels belonging to the column of number (4L-3), the column of number (4L-2), the column of number (4L-1) and the column of number 4L in the row of number 4K of PDP 10.

Next, in the third field, first dither matrix circuit 354 generates dither coefficients which are the same as the dither coefficients generated in the second field.

Then, in the fourth field, first dither matrix circuit 354 generates dither coefficients which are the same as the dither coefficients generated in the first field.

First dither matrix circuit 354 repetitively executes the action of generating a series of dither coefficients in the first field to the fourth field as described above, as shown in FIG. 16.

Figure 17:
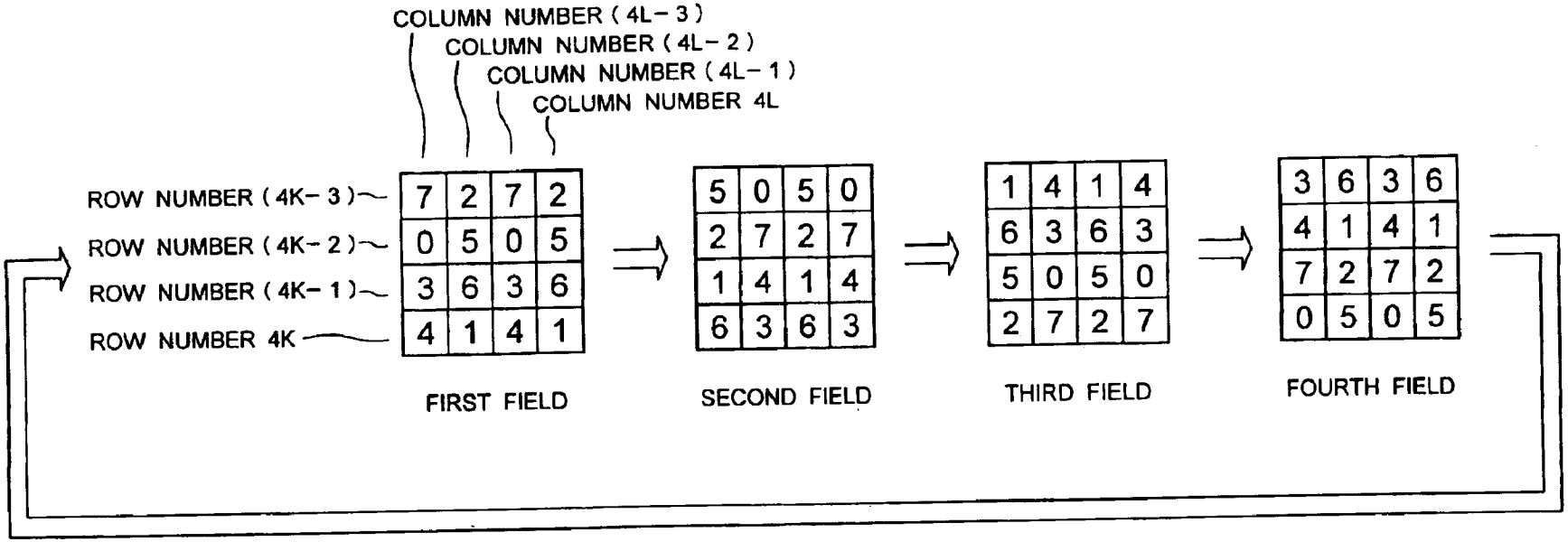
FIG. 17 illustrates four matrices (groups) of pixels, each consisting of four rows X four columns, with dither coefficients generated by the first dither matrix circuit shown in FIG. 14 being allotted to the respective pixels.

Second dither matrix circuit 355 generates dither coefficients corresponding to the pixel positions in a 4 row×4 column pixel group in accordance with a dither matrix table as shown in FIG. 17.

As shown in FIG. 17, second dither matrix circuit 355, in the initial first field, generates dither coefficients

"7 ", "2", "7", "2"

corresponding to the respective pixels belonging to the column of number (4L-3), the column of number (4L-2), the column of number (4L-1) and the column of number 4L in the row of number (4K-3) of PDP 10.

In this first field, second dither matrix circuit 355 generates dither coefficients

"0", "5", "0", "5"

respectively corresponding to the pixels belonging to the column of number (4L-3), the column of number (4L-2), the column of number (4L-1) and the column of number 4L in the row of number (4K-2) of PDP 10.

In this first field, second dither matrix circuit 355 generates dither coefficients

"3", "6", "3", "6"

respectively corresponding to the pixels belonging to the column of number (4L-3), the column of number (4L-2), the column of number (4L-1) and the column of number 4L in the row of number (4K-1) of PDP 10.

Furthermore, in this first field, second dither matrix circuit 355 generates dither coefficients

"4", "1", "4", "1"

respectively corresponding to the pixels belonging to the column of number (4L-3), the column of number (4L-2), the column of number (4L-1) and the column of number 4L in the row of number 4K of PDP 10.

Next , in the second field, second dither matrix circuit 355 generates dither coefficients

"5", "0", "5", "0"

respectively corresponding to the pixels belonging to the column of number (4L-3), the column of number (4L-2), the column of number (4L-1) and the column of number 4L in the row of number (4K-3) of PDP 10.

In the second field, second dither matrix circuit 355 generates dither coefficients

"2", "7", "2", "7"

respectively corresponding to the pixels belonging to the column of number (4L-3), the column of number (4L-2), the column of number (4L-1) and the column of number 4L in the row of number (4K-2) of PDP 10.

In the second field, second dither matrix circuit 355 generates dither coefficients

"1", "4", "1", "4"

respectively corresponding to the pixels belonging to the column of number (4L-3), the column of number (4L-2), the column of number (4L-1) and the column of number 4L in the row of number (4K-1) of PDP 10.

In this second field, second dither matrix circuit 355 generates dither coefficients

"6", "3", "6", "3"

respectively corresponding to the pixels belonging to the column of number (4L-3), the column of number (4L-2), the column of number (4L-1) and the column of number 4L in the row of number 4K of PDP 10.

Next, in the third field, second dither matrix circuit 355 generates dither coefficients

"1", "4", "1", "4"

respectively corresponding to the pixels belonging to the column of number (4L-3), the column of number (4L-2), the column of number (4L-1) and the column of number 4L in the row of number (4K-3) of PDP 10.

In this third field, second dither matrix circuit 355 generates dither coefficients

"6", "3", "6", "3"

respectively corresponding to the pixels belonging to the column of number (4L-3), the column of number (4L-2), the column of number (4L-1) and the column of number 4L in the row of number (4K-2) of PDP 10.

In this third field, second dither matrix circuit 355 generates dither coefficients

"5", "0", "5", "0"

respectively corresponding to the pixels belonging to the column of number (4L-3), the column of number (4L-2), the column of number (4L-1) and the column of number 4L in the row of number (4K-1) of PDP 10.

In this third field, second dither matrix circuit 355 generates dither coefficients

"2", "7", "2", "7"

respectively corresponding to the pixels belonging to the column of number (4L-3), the column of number (4L-2), the column of number (4L-1) and the column of number 4L in the row of number 4K of PDP 10.

Next, in the fourth field, second dither matrix circuit 355 generates dither coefficients

"3", "6", "3", "6"

respectively corresponding to the pixels belonging to the column of number (4L-3), the column of number (4L-2), the column of number (4L-1) and the column of number 4L in the row of number (4K-3) of PDP 10.

In this fourth field, second dither matrix circuit 355 generates dither coefficients

"4", "1", "4", "1"

respectively corresponding to the pixels belonging to the column of number (4L-3), the column of number (4L-2), the column of number (4L-1) and the column of number 4L in the row of number (4K-2) of PDP 10.

In this fourth field, second dither matrix circuit 355 generates dither coefficients

"7", "2", "7", "2"

respectively corresponding to the pixels belonging to the column of number (4L-3), the column of number (4L-2), the column of number (4L-1) and the column of number 4L in the row of number (4K-1) of PDP 10.

In this fourth field, second dither matrix circuit 355 generates dither coefficients

"0", "5", "0", "5"

respectively corresponding to the pixels belonging to the column of number (4L-3), the column of number (4L-2), the column of number (4L-1) and the column of number 4L in the row of number 4K of PDP 10.

Second dither matrix circuit 355 repetitively executes the action of generating a series of dither coefficients in the first field to the fourth field, as shown in FIG. 17.

If the brightness range identifying signal BL supplied from brightness range identifying circuit 351 is of logic level "1", selector 353 supplies the dither coefficients generated by first dither matrix circuit 354 to adder 356. On the other hand, if the brightness range identifying signal BL is of logic level "0", selector 353 supplies the dither coefficients generated by second dither matrix circuit 355 to adder 356. That is, if the brightness level represented by the error diffusion-processed pixel data ED is within the intermediate brightness range, selector 353 supplies to adder 356 dither coefficients as shown in FIG. 16 but otherwise supplies dither coefficients as shown in FIG. 17.

Adder 356 adds the incoming dither coefficients supplied from selector 353 to the error diffusion-processed pixel data ED. Adder 356 supplies the result of this addition to high bit extraction circuit 357 as dither-added pixel data. High bit extraction circuit 357 extracts the high four bits from this dither-added pixel data and outputs them as multi-gradation pixel data PDS.

As described above, dither processing circuit 350 is arranged to perform dither processing wherein each 4-row×4-column pixel group in PDP 10 is taken as a single display unit. That is, the dither coefficients "0" to "7" expressed by three bits are allocated and added as shown in FIG. 16 or FIG. 17 to the lowest three bits of the respective error diffusion-processed pixel data ED corresponding to the respective (16) pixels in a 4-row×4-column pixel group. When the dither coefficients "0" to "7" expressed by three bits are added to the lowest three bits of the respective error diffusion-processed pixel data ED corresponding to the respective 16 pixels, one of the following eight end-around carry conditions is produced:

1) end-around carry is produced only at the pixel to which the dither coefficient "7" is added;

2) end-around carry is produced at those pixels to which dither coefficients "6" and "7" are added;

3) end-around carry is produced at those pixels to which dither coefficients "5" to "7" are added;

4) end-around carry is produced at those pixels to which dither coefficients "4" to "7" are added;

5) end-around carry is produced at those pixels to which dither coefficients "3" to "7" are added;

6) end-around carry is produced at those pixels to which dither coefficients "2" to "7" are added;

7) end-around carry is produced at those pixels to which dither coefficients "1" to "7" are added; and 8) end-around carry is not produced at any of the pixels.

Thus, the effect (influence) of such end-around carry is reflected in the highest four bits in the dither-added pixel data that are output from adder 356. Consequently, if the 4-row×4-column pixel groups are regarded as single display units, eight types of combination are generated in terms of the brightness represented by the highest four bits in the dither-added pixel data. That is, even if the bit number of the multi-gradation pixel data PDS obtained by high bit extraction circuit 357 is for example four bits, 7 bits-equivalent intermediate-gradation display becomes possible. In other words, the number of brightness gradations that can be expressed is eight times.

Figure 18:
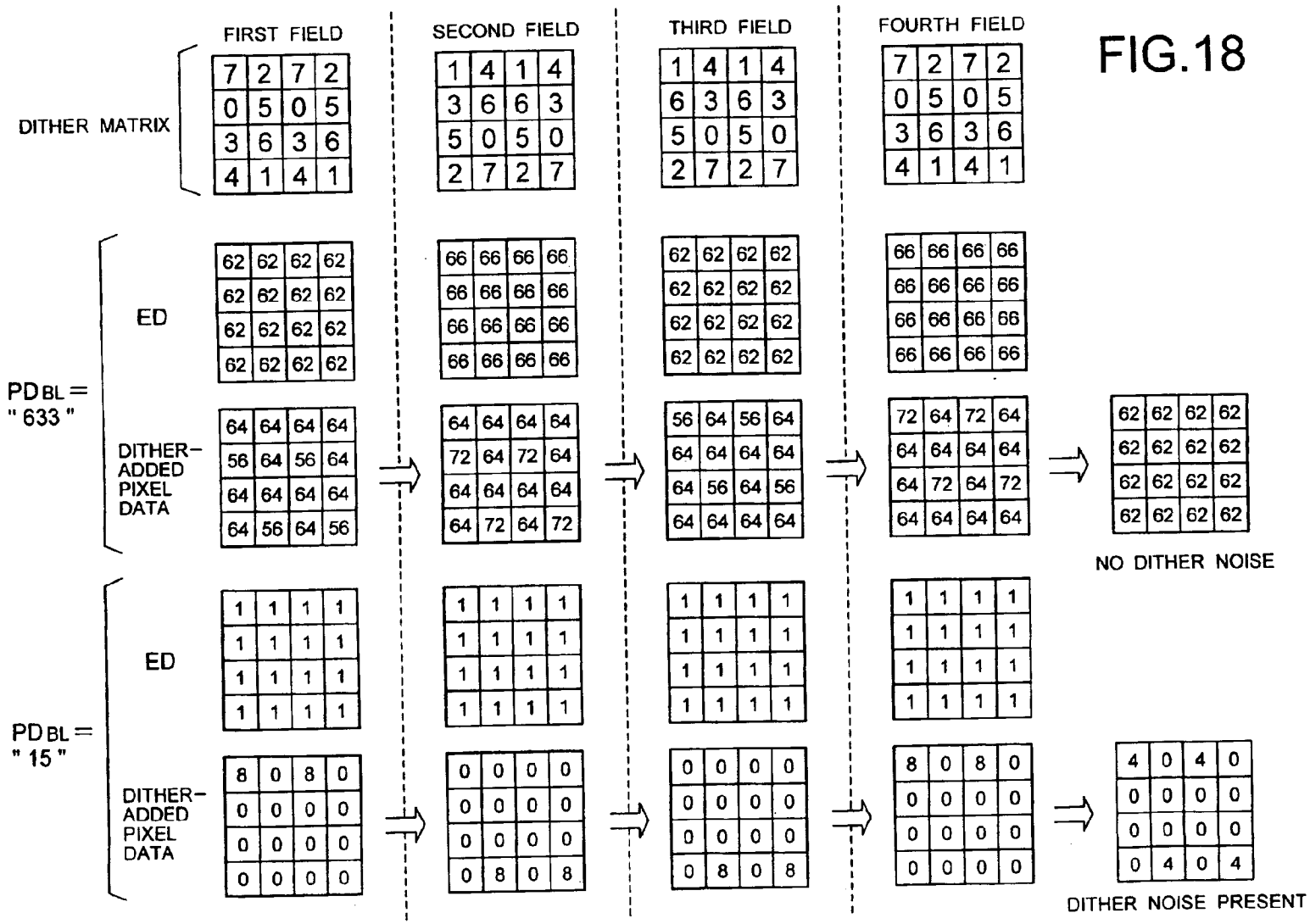
FIG. 18 is a diagram illustrating how the error diffusion-processed pixel data change from the first through fourth fields when the error diffusion-processed pixel data represent an intermediate brightness image ("633") and lower brightness image ("15"), together with the dither-added pixel data resulting from addition of the dither coefficients shown in FIG. 16.

In the above described embodiment, the ability to represent gradations as perceived (by human eyes) is improved by executing, alternately for each field, drive in accordance with the first light emission drive format shown in FIG. 9A and drive in accordance with the second light emission drive format shown in FIG. 9B. In addition, first data conversion circuit 32 shown in FIG. 2 converts the 10-bit brightness-adjusted pixel data PDBL to 9-bit brightness-converted pixel data PDH in order to suppress the occurrence of brightness saturation and gradation distortion produced by the multi-gradation processing. In this process, first data conversion circuit 32 performs data conversion in accordance with the conversion characteristic as shown in FIG. 6 whilst drive is being effected on the basis of the first light emission drive format but performs data conversion in accordance with the conversion characteristic as shown in FIG. 7 whilst drive is being effected on the basis of the second light emission drive format. The value of the error diffusion-processed pixel data ED that is input to dither processing circuit 350 therefore changes with each field even when for example a video signal is input representing an image in which there is no change of brightness over a long period. For instance when brightness-adjusted pixel data PDBL representing "633" is supplied, first data conversion circuit 32 converts this data to brightness-adjusted pixel data PDH "248", using the conversion characteristic shown in FIG. 6, in the case of odd-numbered fields. That is, expressed in binary form, it is converted to 9-bit brightness-converted pixel data PDH "011111000". When error diffusion processing is performed on this brightness-converted pixel data PDH, 7-bit error diffusion-processed pixel data ED "0111110" expressed by the highest seven bits of "011111000" is obtained. Converted to a decimal number, this is "62". In the case of even-numbered fields, first data conversion circuit 32 converts the brightness-adjusted pixel data PDBL "633" mentioned above to brightness-adjusted pixel data PDH "265", using the conversion characteristic shown in FIG. 7. That is, expressed in binary form, it converts the pixel data PDBL to the 9-bit brightness-converted pixel data PDH "100001001". When error diffusion processing is performed on this brightness-converted pixel data PDH, the 7-bit error diffusion-processed pixel data ED "1000010" expressed by the highest seven bits of "100001001" is obtained. Converted to decimal form, this pixel data ED is "66". Consequently, as shown in FIG. 18, in the case of the first and third fields, error diffusion-processed pixel data ED corresponding to "62" allocated to the pixels in the 4-row×4-column pixel group is input to the dither processing circuit 350, while, in the case of the second and fourth fields, error diffusion-processed pixel data ED corresponding to "66" allocated to the pixels in the 4-row×4-column pixel group is input to the dither processing circuit 350. An offset of "4" is thereby produced between the error diffusion-processed pixel data ED in the case of the first and third fields and the error diffusion-processed pixel data ED in the case of the second and fourth fields. This therefore gives rise to a risk of dither noise being generated if dither addition is performed using a dither pattern wherein the combinations of dither coefficients corresponding to the pixels of the 4-row×4-column pixel group are the same for all of the first to fourth fields. Accordingly, the offset of "4" is taken into account, and as shown in FIG. 16, it is arranged for dither addition to be performed using a dither pattern in which the values of the dither coefficients corresponding to the pixels of the 4-row×4-column pixel group are interchanged for each two fields. Thus, if dither coefficients shown in FIG. 16 are added to the error diffusion-processed pixel data ED corresponding to 4-rows×4-columns of "62" in the case of the first and third fields, but of "66" in the case of the second and fourth fields, dither-added pixel data (the values expressed by the lowest three bits are discarded) as shown in FIG. 18 is obtained. If this is done, by the integration effect in the time direction between the first and fourth fields, a brightness corresponding to "62" is perceived in all of the 16 pixels of the 4-row×4-column pixel group i.e., image display with no so-called dither noise is produced.

However, if a video signal representing an image of extremely high brightness or extremely low brightness is input, the amount of offset between the brightness-converted pixel data PDH obtained by conversion using the conversion characteristic shown in FIG. 6 and the brightness-converted pixel data PDH obtained by conversion using the conversion characteristic as shown in FIG. 7 is 0. The values of the error diffusion-processed pixel data ED corresponding to 4 rows×4 columns are therefore the same over all periods. Therefore, dither noise may be produced if dither coefficients shown in FIG. 16 generated taking into account the offset amount "4" are added.

For example, in the case of the odd-numbered fields, if brightness-adjusted pixel data PDBL "15" expressing extremely low brightness is supplied, the first data conversion circuit 32 converts this pixel data PDBL "15" into brightness-converted pixel data PDH of "4", in accordance with the conversion characteristic as shown in FIG. 6. That is, expressed in binary terms, the pixel data PDBL is converted into 9-bit brightness-converted pixel data PDH of "000000100". If then error diffusion processing is performed on this brightness-converted pixel data PDH, 7-bit error diffusion-processed pixel data ED of "0000001" expressed by the highest seven bits of "000000100" is obtained. In decimal terms, this pixel data ED is "1". In the case of even-numbered fields, first data conversion circuit 32 converts brightness-adjusted pixel data PDBL of "15" to brightness-converted pixel data PDH of "6" in accordance with the conversion characteristic as shown in FIG. 7. That is, in binary terms, it converts the pixel data PDBL to 9-bit brightness-converted pixel data PDH of "000000110". If then error diffusion processing is performed on this brightness-converted pixel data PDH, 7-bit error diffusion-processed pixel data ED of "0000001" expressed by the highest seven bits of "000000110" is obtained. In decimal terms this pixel data ED is "1". Consequently, as shown in FIG. 18, over the first to the fourth fields, "1" is input to dither processing circuit 350 as the error diffusion-processed pixel data ED corresponding to each pixel in the 4-row×4-column pixel group. If then dither coefficients as shown in FIG. 16 are added to this error diffusion-processed pixel data ED, dither-added pixel data as shown in FIG. 18 (the values expressed by the lowest three bits are discarded) is obtained. Thus, as shown in FIG. 18, due to the integration effect in the time direction between the first and fourth fields pixels whose brightness is perceived as corresponding to "4" occur sporadically, in the 4-row×4-column pixel group, together with the pixels of brightness corresponding to "0" (i.e. pixels in the extinguished condition); thus dither noise is generated.

Figure 19:
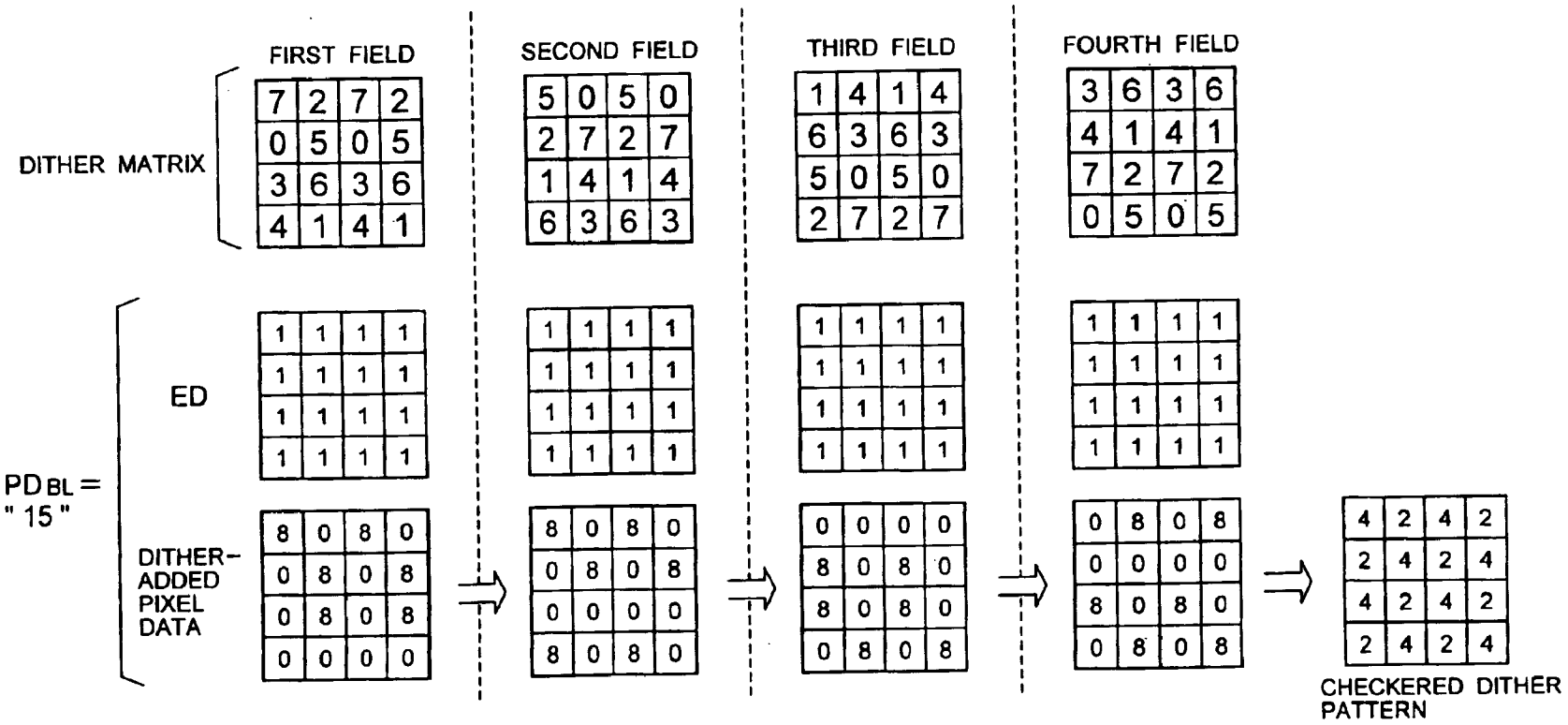
FIG. 19 is a view illustrating the changes of the error diffusion-processed pixel data from the first to fourth fields when the error diffusion-processed pixel data represents a lower brightness image ("15"), together with the dither-added pixel data after addition of the dither coefficients shown in FIG. 17.

Accordingly, in the present embodiment, dither addition is performed using dither coefficients as shown in FIG. 17 instead of FIG. 16 if the brightness level expressed by the error diffusion-processed pixel data ED is of very low brightness or of very high brightness. If the dither coefficients shown in FIG. 17 are added to the error diffusion-processed pixel data ED of "1" over the first to the fourth fields, dither-added pixel data as shown in FIG. 19 are obtained (the values expressed by the lowest three bits are discarded). A so-called checkered dither pattern is then generated in which pixels perceived with brightness corresponding to "4" and pixels perceived with brightness corresponding to "2" are displayed alternately in the 4-row×4-column pixel group as shown in FIG. 19, by the integration effect in the time direction between the first and fourth fields. Since a checkered dither pattern is not easily perceived, the result is that dither noise is suppressed.

As described above, in this embodiment, when the brightness of the image represented by the input video signal (error diffusion-processed pixel data ED) is within a prescribed intermediate brightness range, dither processing is executed using the dither coefficients shown by the dither matrix of FIG. 16, but, when the brightness of the image represented by the input video signal is very low or very high, dither processing is executed using the dither coefficients shown by the dither matrix of FIG. 17. In this way, excellent image display can be achieved with the reduced dither noise.

Figure 20A:
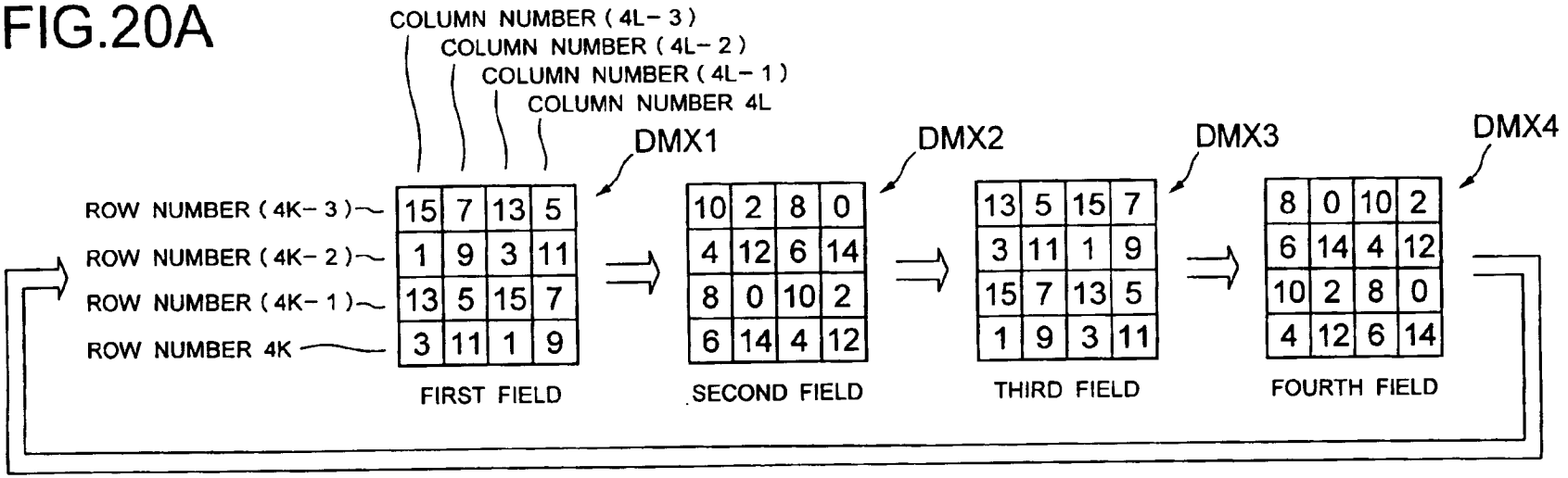
FIG. 20A is a view illustrating another example of four matrices (groups) of pixels, each consisting of four rows× four columns, with dither coefficients generated by the second dither matrix circuit shown in FIG. 14 being allotted to the respective pixels, when displaying a low brightness image.
Figure 20B:
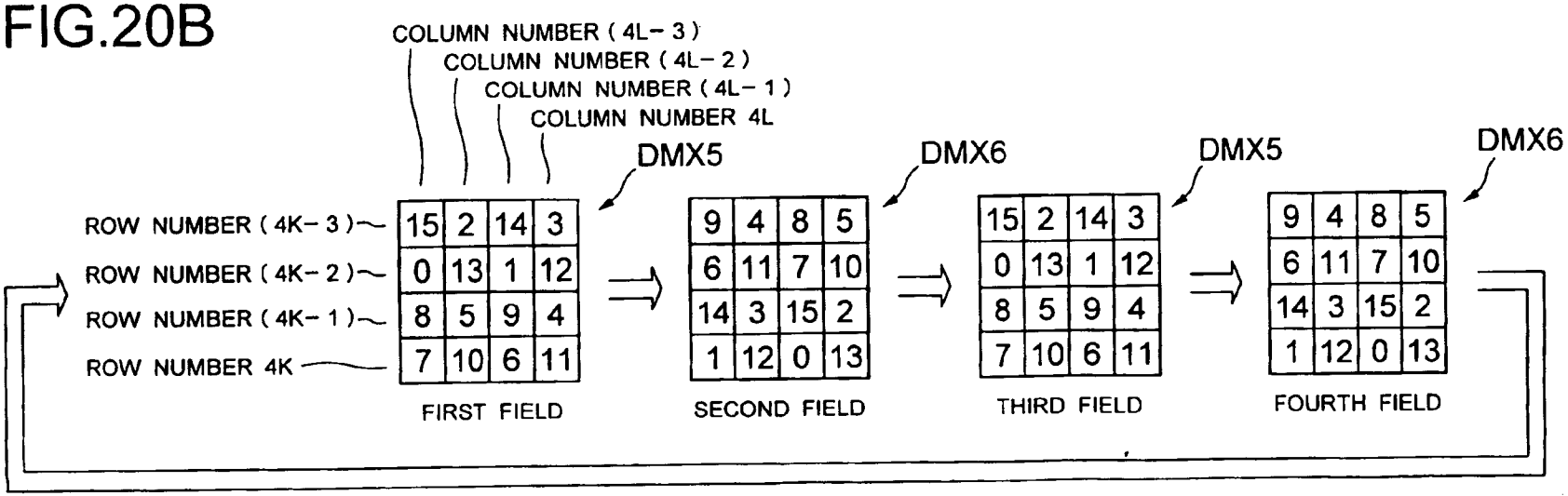
FIG. 20B is a view illustrating still another example of four matrices (groups) of pixels, each consisting of four rows×four columns, with dither coefficients generated by the second dither matrix circuit shown in FIG. 14 being allotted to the respective pixels, when displaying a high brightness image.

It should be noted that, although the dither coefficients have eight values from 0 to 7 in the above described embodiment, the present invention is not limited in this regard. Further, although the dither coefficients expressed by the dither matrix of FIG. 17 are employed both in the case where the brightness of the image expressed by the input video signal is low brightness and in the case where this is high brightness in the above described embodiment, the present invention is not limited in this regard. For example, the dither matrix used in the case of low brightness may differ from the dither matrix used in the case of high brightness. FIGS. 20A and 20B show another examples of a dither matrix prepared with this point in mind.

FIG. 20A shows the matrix of dither coefficients generated by second dither matrix circuit 355 when the brightness expressed by the error diffusion-processed pixel data ED is low brightness. FIG. 20B shows the matrix of dither coefficients generated by second dither matrix circuit 355 when the brightness expressed by the error diffusion-processed pixel data ED is high brightness.

Specifically, when displaying an image of low brightness, second dither matrix circuit 355 generates in each respective field four types of dither matrices DMX1 to DMX4 as shown in FIG. 20A, comprising 16 dither coefficients (0 to 15) corresponding to the pixels of 4 rows×4 columns of PDP 10. Second dither matrix circuit 355 generates these four dither matrices DMX1 to DMX4 repeated with a period of four fields. On the other hand, when displaying an image of high brightness, second dither matrix circuit 355 generates in each respective field alternately, two types of dither matrices DMX5 and DMX6, as shown in FIG. 20B. Second dither matrix circuit 355 generates these two dither matrices DMX5 and DMX6 repeated with a period of two fields.

Consequently, with the dither matrices shown in FIGS. 20A and 20B, the period of change of the dither pattern is shorter in the case of high-brightness image display than in the case of low-brightness image display. This reduces the flicker which is said to be more noticeable during high-brightness image display.

This application is based on Japanese Patent Application No. 2001-196253, the entire disclosure of which is incorporated herein by reference.

What is claimed is:

1. A display device for displaying an image in response to a video signal on a display screen, with a plurality of display cells being provided as pixels in the display screen and a pixel group being defined by a plurality of pixels, the display device comprising:

a display having the display screen;

a dither coefficient generator for generating dither coefficients for respective pixels in the pixel group such that the dither coefficients are allotted to respective pixel positions in the pixel group;

a dither adder for adding the dither coefficients to respective pixel data, each pixel data corresponding to each pixel in the pixel group, derived from the video signal to obtain dither-added pixel data; and a display drive for causing the display cells to emit light with brightness corresponding to the respective dither-added pixel data, wherein said dither coefficient generator comprises a selection device, a first dither matrix circuit and a second dither matrix circuit, and wherein further the selection device is operable to selectively choose between different respective sets of dither coefficients from the first and second dither matrix circuits depending on whether or not a brightness level of the image displayed by the pixel data is within a predetermined brightness range.

2. The display device according to claim 1, wherein said dither coefficient generator further alters the values of the dither coefficients for each single field display period in said video signal.

3. The display device according to claim 1, wherein said pixel group is a group of pixels arranged in N rows and M columns adjacent to each other in said display screen.

4. The display device according to claim 1, wherein said single field display period is defined by a plurality of subfields, and said display drive includes:

an addressing unit for setting each of said display cells either to a light emission cell condition or an extinguished cell condition in accordance with said dither-added pixel data in each of said subfields; and a light emission maintenance unit for causing only said display cells in said light emission cell condition to emit light in said respective subfields, for respective light-emission periods corresponding to weighting of said subfields, and wherein said light emission maintenance unit alters said light-emission periods in said respective subfields for each said single field display period.

5. A display device for displaying an image in response to a video signal on a display screen, with a plurality of display cells being provided as pixels in the display screen and a pixel group being defined by a plurality of pixels, the display device comprising:

a display having the display screen;

a pixel data generator for generating pixel data in accordance with said video signal such that each pixel data corresponds to each respective pixel in the pixel group;

a data convener for convening a brightness level of the image displayed by said pixel data using a first conversion characteristic and a second conversion characteristic having a conversion characteristic different from said first conversion characteristic alternatively in each single field display period of said video signal, thereby obtaining brightness-converted pixel data;

a dither coefficient generator for generating dither coefficients for the respective pixels in the pixel group such that the dither coefficients are allotted to respective pixel positions in the pixel group;

a dither adder for adding the dither coefficients to the respective brightness-converted pixel data to obtain dither-added pixel data; and a display drive for causing the display cells to emit light with brightness corresponding to the respective dither-added pixel data, wherein said dither coefficient generator comprises a selection device, a first dither matrix circuit and a second dither matrix circuit, and wherein further the selection device is operable to selectively choose between different respective sets of dither coefficients from the first and second dither matrix circuits depending on whether or not a brightness level of the image displayed by the pixel data is within a predetermined brightness range.

6. The display device according to claim 5, wherein said first conversion characteristic and said second conversion characteristic have different conversion characteristics in a low brightness region of lower brightness than said prescribed brightness, and furthermore have different conversion characteristics in a region included in said intermediate brightness region.

7. The display device according to claim 5, wherein said dither coefficient generator further alters the values of the dither coefficients in each single field display period of said video signal.

8. The display device according to claim 5, wherein said pixel group is a group of pixels arranged in N rows and M columns adjacent to each other in said display screen.

9. The display device according to claim 5, wherein said single field display period is defined by a plurality of subfields, and said display drive includes:

an addressing unit for setting each of said display cells either to a light emission cell condition or an extinguished cell condition in accordance with said dither-added pixel data in each of said subfields; and a light emission maintenance unit for causing only said display cells in said light emission cell condition to emit light in said respective subfields, for respective light-emission periods corresponding to weighting of said subfields, and wherein said light emission maintenance unit alters said light-emission periods in said respective subfields for each said single field display period.

10. An apparatus for displaying an image in response to a video signal on a display screen, with a plurality of display cells being provided as pixels in the display screen and a pixel group being defined by a plurality of pixels, the apparatus comprising:

coefficient generating means for generating dither coefficients for respective pixels in the pixel group such that the dither coefficients are allotted to respective pixel positions in the pixel group;

adding means for adding the dither coefficients to respective pixel data, each pixel data corresponding to each pixel in the pixel group, derived from the video signal to obtain dither-added pixel data; and drive means for causing the display cells to emit light with brightness corresponding to the respective dither-added pixel data, wherein the coefficient generating means comprises selection means, a first dither matrix circuit means and a second dither matrix circuit means, and wherein further the selection means is for selectively choosing between different respective sets of dither coefficients from the first and second dither matrix circuit means depending on whether or not a brightness level of the image displayed by the pixel data is within a predetermined brightness range.

11. The apparatus according to claim 10, wherein said coefficient generating means further alters the values of the dither coefficients for each single field display period in said video signal.

12. The apparatus according to claim 10, wherein said pixel group is a group of pixels arranged in N rows and M columns adjacent to each other in said display screen.

13. The apparatus according to claim 10, wherein said single field display period is defined by a plurality of subfields, and said drive means includes:

means for setting each of said display cells either to a light emission cell condition or an extinguished cell condition in accordance with said dither-added pixel data in each of said subfields; and maintaining means for causing only said display cells in said light emission cell condition to emit light in said respective subfields, for respective light-emission periods corresponding to weighting of said subfields, and wherein said maintaining means alters said light-emission periods in said respective subfields for each said single field display period.

14. The apparatus according to claim 10 further including means for converting the brightness level of the image displayed by said pixel data using a first conversion characteristic and a second conversion characteristic having a conversion characteristic different from said first conversion characteristic alternatively in each single field display period of said video signal, thereby obtaining brightness-converted pixel data, and wherein the adding means adds the dither coefficients to the respective brightness-converted pixel data to obtain the dither-added pixel data.

15. The apparatus according to claim 14, wherein said first conversion characteristic and said second conversion characteristic have different respective conversion characteristics in a low brightness region of lower brightness, a high brightness region of high brightness and an intermediate brightness region between the low and high brightness regions.

16. A method of displaying an image in response to a video signal on a display screen, with a plurality of display cells being provided as pixels in the display screen and a pixel group being defined by a plurality of pixels, the method comprising the steps of:

A) generating different respective dither coefficients from two or more dither matrix circuits for respective pixels in the pixel group such that the dither coefficients are allotted to respective pixel positions in the pixel group;

B) selectively choosing between the different generated values of the dither coefficients depending on whether or not a brightness level of the image displayed by the pixel data is within a prescribed intermediate brightness range;

C) adding the dither coefficients to respective pixel data, each pixel data corresponding to each pixel in the pixel group, derived from the video signal to obtain dither-added pixel data; and D) causing the display cells to emit light with brightness corresponding to the respective dither-added pixel data.

17. The method according to claim 16, wherein Step B further alters the values of the dither coefficients for each single field display period in said video signal.

18. The method according to claim 16, wherein said pixel group is a group of pixels arranged in N rows and M columns adjacent to each other in said display screen.

19. The method according to claim 16, wherein said single field display period is defined by a plurality of subfields, and Step D includes the sub-steps of:

D1) setting each of said display cells either to a light emission cell condition or an extinguished cell condition in accordance with said dither-added pixel data in each of said subfields;

D2) determining light-emission periods in accordance with weighting of said subfields such that the light-emission periods are altered in said respective subfields for each said single field display period; and D3) causing only said display cells in said light emission cell condition to emit light in said respective subfields, for the respective light-emission periods.

20. The method according to claim 16 further including the steps of:

E) converting the brightness level of the image displayed by said pixel data using a first conversion characteristic and a second conversion characteristic having a conversion characteristic different from said first conversion characteristic alternatively in each single field display period of said video signal, thereby obtaining brightness-converted pixel data before Step C, and wherein Step C adds the dither coefficients to the respective brightness-converted pixel data to obtain dither-added pixel data.

* * * * *

UNITED STATES PATENT AND TRADEMARK OFFICE

CERTIFICATE OF CORRECTION

PATENT NO. : 6,906,726 B2
DATED : June 14, 2005
INVENTOR(S) : Masahiro Suzuki

It is certified that error appears in the above-identified patent and that said Letters Patent is hereby corrected as shown below:

Column 19,
Line 1, please delete "a data convener for convening" and insert -- a data converter for converting --.

Signed and Sealed this

Fourth Day of October, 2005

JON W. DUDAS
*Director of the United States Patent and Trademark Office*